US008988237B2

(12) United States Patent
Liu et al.

(10) Patent No.: US 8,988,237 B2
(45) Date of Patent: Mar. 24, 2015

(54) SYSTEM AND METHOD FOR FAILURE PREDICTION FOR ARTIFICIAL LIFT SYSTEMS

(75) Inventors: Yintao Liu, Los Angeles, CA (US); Ke-Thia Yao, Los Angeles, CA (US); Shuping Liu, Los Angeles, CA (US); Cauligi Srinivasa Raghavendra, Los Angeles, CA (US); Oluwafemi Opeyemi Balogun, Rosenberg, TX (US); Lanre Olabinjo, Sugar Land, TX (US)

(73) Assignee: University of Southern California, Los Angeles, CA (US)

( * ) Notice: Subject to any disclaimer, the term of this patent is extended or adjusted under 35 U.S.C. 154(b) by 643 days.

(21) Appl. No.: 13/330,895

(22) Filed: Dec. 20, 2011

(65) Prior Publication Data

US 2012/0191633 A1 Jul. 26, 2012

Related U.S. Application Data

(63) Continuation-in-part of application No. 13/118,067, filed on May 27, 2011.

(60) Provisional application No. 61/349,121, filed on May 27, 2010.

(51) Int. Cl.
*G08B 21/00* (2006.01)
*E21B 47/00* (2012.01)

(52) U.S. Cl.
CPC ..... *E21B 47/0007* (2013.01)
USPC ..... 340/679

(58) Field of Classification Search
CPC ..... G07C 3/00
USPC ..... 340/679; 166/244.1, 245, 254.2
See application file for complete search history.

(56) References Cited

U.S. PATENT DOCUMENTS

| | | | | |
|---|---|---|---|---|
| 3,941,949 | A | 3/1976 | Miller et al. | |
| 5,643,212 | A | 7/1997 | Coutréet al. | |
| 5,823,262 | A | 10/1998 | Dutton | |
| 5,995,910 | A * | 11/1999 | Discenzo | 702/56 |
| 6,119,060 | A | 9/2000 | Takayama et al. | |
| 6,343,656 | B1 * | 2/2002 | Vazquez et al. | 166/373 |

(Continued)

OTHER PUBLICATIONS

Basu, Sugato, et al.; "Semi/supervised Clustering by Seeding"; Proceedings of the 19th International Conference on Machine Learning, (ICML), Jul. 2002, pp. 19-26, Sydney, AU.

(Continued)

*Primary Examiner* — Hai Phan
*Assistant Examiner* — Zhen Y Wu
(74) *Attorney, Agent, or Firm* — Pillsbury Winthrop Shaw Pittman, LLP

(57) ABSTRACT

A computer-implemented reservoir prediction system, method, and software are provided for failure prediction for artificial lift systems, such as sucker rod pump systems. The method includes a production well associated with an artificial lift system and data indicative of an operational status of the artificial lift system. One or more features are extracted from the artificial lift system data. Data mining is applied to the one or more features to determine whether the artificial lift system is predicted to fail within a given time period. An alert is output indicative of impending artificial lift system failures.

20 Claims, 17 Drawing Sheets

(56) References Cited

U.S. PATENT DOCUMENTS

| | | | | |
|---|---|---|---|---|
| 6,393,101 | B1 | 5/2002 | Barshefsky et al. | |
| 6,396,904 | B1 | 5/2002 | Lilley et al. | |
| 6,408,953 | B1 | 6/2002 | Goldman et al. | |
| 6,456,993 | B1 * | 9/2002 | Freund | 706/46 |
| 7,711,486 | B2 | 5/2010 | Thigpen et al. | |
| 7,979,240 | B2 | 7/2011 | Fielder | |
| 8,201,424 | B2 | 6/2012 | Bodden et al. | |
| 2001/0002932 | A1 | 6/2001 | Matsuo et al. | |
| 2002/0074127 | A1 | 6/2002 | Birckhead et al. | |
| 2004/0133289 | A1 | 7/2004 | Larsson et al. | |
| 2004/0199362 | A1 * | 10/2004 | Cao et al. | 702/185 |
| 2005/0010311 | A1 | 1/2005 | Barbazette et al. | |
| 2005/0161260 | A1 | 7/2005 | Koithan et al. | |
| 2005/0172171 | A1 | 8/2005 | Kadashevich | |
| 2006/0040711 | A1 | 2/2006 | Whistler | |
| 2006/0074825 | A1 * | 4/2006 | Mirowski | 706/20 |
| 2006/0176186 | A1 * | 8/2006 | Larson et al. | 340/635 |
| 2006/0228225 | A1 | 10/2006 | Rogers | |
| 2006/0291876 | A1 | 12/2006 | Kawai et al. | |
| 2007/0010998 | A1 * | 1/2007 | Radhakrishnan et al. | 704/211 |
| 2007/0121519 | A1 | 5/2007 | Cuni et al. | |
| 2007/0252717 | A1 | 11/2007 | Fielder | |
| 2007/0263488 | A1 | 11/2007 | Clark | |
| 2008/0006089 | A1 | 1/2008 | Adnan et al. | |
| 2008/0010020 | A1 | 1/2008 | Ellender et al. | |
| 2008/0100436 | A1 | 5/2008 | Banting et al. | |
| 2008/0106424 | A1 * | 5/2008 | Bouse et al. | 340/635 |
| 2008/0118382 | A1 | 5/2008 | Ramsey et al. | |
| 2008/0126049 | A1 | 5/2008 | Bailey et al. | |
| 2008/0221714 | A1 | 9/2008 | Schoettle | |
| 2008/0253626 | A1 | 10/2008 | Shuckers et al. | |
| 2008/0262736 | A1 | 10/2008 | Thigpen et al. | |
| 2008/0285382 | A1 | 11/2008 | Valero et al. | |
| 2008/0313112 | A1 * | 12/2008 | Vapnik et al. | 706/12 |
| 2009/0037458 | A1 | 2/2009 | Meyer et al. | |
| 2009/0063387 | A1 | 3/2009 | Beaty et al. | |
| 2010/0082143 | A1 * | 4/2010 | Pantaleano et al. | 700/105 |
| 2010/0111716 | A1 | 5/2010 | Gibbs et al. | |
| 2010/0125470 | A1 | 5/2010 | Chisholm | |
| 2010/0169446 | A1 | 7/2010 | Linden et al. | |
| 2010/0312477 | A1 | 12/2010 | Sanstrom et al. | |
| 2011/0078516 | A1 | 3/2011 | El/Kersh et al. | |
| 2011/0099010 | A1 | 4/2011 | Zhang | |
| 2011/0106734 | A1 * | 5/2011 | Boult et al. | 706/12 |
| 2011/0178963 | A1 | 7/2011 | Hartman et al. | |
| 2011/0184567 | A1 | 7/2011 | Sonnier | |
| 2011/0225111 | A1 * | 9/2011 | Ringer | 706/14 |
| 2011/0246409 | A1 | 10/2011 | Mitra | |
| 2011/0320168 | A1 | 12/2011 | Lake et al. | |
| 2012/0025997 | A1 | 2/2012 | Liu et al. | |
| 2012/0109243 | A1 | 5/2012 | Hettrick et al. | |
| 2012/0143565 | A1 | 6/2012 | Graham, III et al. | |
| 2012/0191633 | A1 | 7/2012 | Liu et al. | |
| 2013/0080117 | A1 | 3/2013 | Liu et al. | |
| 2013/0151156 | A1 | 6/2013 | Noui/Mehidi et al. | |
| 2013/0173165 | A1 | 7/2013 | Balogun et al. | |
| 2013/0173505 | A1 | 7/2013 | Balogun et al. | |
| 2013/0212443 | A1 | 8/2013 | Ikegami | |
| 2014/0244552 | A1 | 8/2014 | Liu et al. | |

OTHER PUBLICATIONS

Bremner, Chad, et al.; "Evolving Technologies: Electrical Submersible Pumps"; Oilfield Review, Winter 2006/2007, pp. 30-43.

Ruggeri, F., et al.; "Bayesian Networks"; Ben-Gal I., Encyclopedia of Statistics in Quality & Reliability, Wiley & Sons, 2007, pp. 1-6.

Non-Final Office Action mailed May 20, 2013, during the prosecution of Co-Pending U.S. Appl. No. 13/118,067, filed May 27, 2011.

Final Office Action mailed Sep. 27, 2013, during the prosecution of Co-Pending U.S. Appl. No. 13/118,067, filed May 27, 2011.

Non-Final Office Action mailed Mar. 17, 2014, during the prosecution of Co-Pending U.S. Appl. No. 13/351,318, filed Jan. 17, 2012.

Non-Final Office Action mailed Jun. 19, 2014, during the prosecution of Co-Pending U.S. Appl. No. 13/118,067, filed date May 27, 2011.

U.S. Notice of Allowance dated Nov. 7, 2014 for U.S. Appl. No. 13/118,067.

* cited by examiner

Feature Extraction

Input: Time series $T_i$ for $U_i \in U$, dual step size $[step_1, step_2]$, global normalization size $D$
Return: Features $\{F_i\}$
Initial: $F_i = \emptyset$
Segment $T_i$ according to its failure events
for each segment do
  for each attribute $a_j$ within this segment do
    Slide from beginning with fixed window size $step_1 + step_2$
    Extract trends from each window by
    $m = median(\{a_{previous_D_records}\})$
    $m_1 = median(\{a_{initial_step_1_records}\})$
    $m_2 = median(\{a_{next_step_2_records}\})$
    $f_{ij} = [m_1, m_2]/m$
    $F_{ij} = F_{ij} \cup f_{ij}$
  end for
  $F_i = F_i \cup F_{ij}$
end for
return $F_i$

FIG. 6

Training Selection

Input: Failure set $X$, normal set $X'$, threshold $\gamma$
Return: Training set $\{L\}$
Initial: $L = \emptyset$
Segment $T_i$ according to its failure events
while $(\frac{TP}{TP+FN} < \gamma$ or $\Delta(\frac{TP}{TP+FN}) < \delta)$ do

$$\arg\max_{X_i \in X} f(X_i) = \{\frac{TP}{TP+FN} | Train_and_Test(L \cup X_i)\}$$

$$L = L \cup X_i$$

end while
while $(\frac{TP}{TP+FN} > \gamma$ and $\Delta(\frac{TP}{TP+FP}) < \delta)$ do

$$\arg\max_{X'_i \in X'} f(X'_i) = \{\frac{TP}{TP+FP} | Train_and_Test(L \cup X'_i)\}$$

$$L = L \cup X'_i$$

end while

FIG. 8

Semi-Supervised Learning using Random Peek

Input: Training set $L$, testing set $X$
Return: Classification result $Y$
Initial: $Y = \emptyset$
for testing well $X_i \in X$ do
  Clustering $X_i$ to get $C_1$, $C_2$, where $\|C_1\| > \|C_2\|$
  Label centroid $Center_1 \in C_1$, label it as $normal$
  Update training set $L_i = L \cup Center_1$ to get $f_i$
  Testing on $X_i$ to get $Y_i = f_i(X_i)$
  $Y = Y \cup Y_i$
end for

FIG. 9

SYSTEM AND METHOD FOR FAILURE PREDICTION FOR ARTIFICIAL LIFT SYSTEMS

CROSS-REFERENCE TO RELATED APPLICATIONS

The present application for patent claims the benefit of U.S. provisional application bearing Ser. No. 61/349,121, filed on May 27, 2010, and is a continuation-in-part of United States non-provisional application bearing Ser. No. 13/118,067, filed on May 27, 2011, both of which are incorporated herein by reference in their entirety.

TECHNICAL FIELD

This invention relates to artificial lift system failures in oil field assets, and more particularly, to a system, method, and computer program product for predicting failures in artificial lift systems.

BACKGROUND

Artificial lift systems are widely used to enhance production for reservoirs with formation pressure too low to provide enough energy to directly lift fluids to the surface. Examples of artificial lift systems include gas lift systems, hydraulic pumping units, electric submersible pumps (ESPs), progressive cavity pumps (PCPs), plunger lift systems, and rod pump systems. Sucker rod pumps are currently the most commonly used artificial lift system in the industry.

Sucker rod pump failures can be broadly classified into two main categories: mechanical and chemical. Mechanical failures are typically caused by improper design, by improper manufacturing, or by wear and tear during operations. For example, well conditions such as sand intrusions, gas pounding, and asphalting can contribute to such wear and tear. Chemical failures are generally caused by the corrosive nature of the fluid being pumped through the systems. For example, the fluid may contain hydrogen sulfide ($H_2S$) or bacteria. Typically these mechanical and chemical failures manifest as tubing failures, rod string failures and rod pump failures. These failures initially reduce the efficiency of the pumping operation and ultimately result in system failure, which shuts down the systems and requires reactive well workovers (as opposed to proactive maintenance). Such workovers cause production loss and an increase in Operational Expenditure (OPEX) beyond regular maintenance costs.

Currently pump off controllers (POCs) play a significant role in monitoring the operation of rod pump systems. POCs can be programmed to automatically shut down units if the values of torque and load deviate beyond a torque/load threshold. Also, the general behavior of rod pump systems can be understood by analyzing the dynamometer card patterns collected by the POCs. This helps reduce the amount of work required by the production and maintenance personnel operating in the field. However, the POCs by themselves are not sufficient as a great deal of time and effort is still needed to monitor each and every operating unit. Furthermore, the dataset obtained by POCs poses difficult challenges to data mining and machine learning applications with respect to high dimensionality, noise, and inadequate labeling.

The data collected from POCs is inherently highly dimensional, as POC controllers gather and record periodic artificial lift system measurements indicating production and artificial lift system operational statuses through load cells, motor sensors, pressure transducers and relays. For example, in a dataset having 14 attributes where each attribute is measured daily, the dimension for a single rod pump system is 1400 for a hundred day dataset. This highly dimensional data is problematic as it becomes increasingly difficult to manipulate, find matching patterns, and process the data to construct and apply models efficiently.

Datasets for artificial lift systems also tend to be very noisy. The noise, which can be natural or manmade, is often produced from multiple sources. For example, lightning strikes can sometimes disrupt wireless communication networks. Data collected by the POC sensors, therefore, might not be received by a centralized logging database, which results in missing values in the data. Additionally, artificial lift systems operate in rough physical environments that often leads to equipment break down. Petroleum engineering field workers regularly perform maintenance and make calibration adjustments to the equipment. These maintenance activities and adjustments can cause the sensor measurements to change—sometimes considerably. It is currently not standard practice to record such adjustments and recalibrations. Furthermore, while workers are generally diligent with regards to logging their work in downtime and workover database tables, occasionally a log entry is delayed or not logged at all. Another source of data noise is the variation caused by the force drive mechanisms. Lastly, in oil fields with insufficient formation pressure, injection wells are sometimes used to inject fluids (e.g., water, steam, carbon dioxide) to drive the oil toward the oil production wells. This injection can also affect the POC sensors measurements.

The dataset is also not explicitly labeled. Manually labeling the dataset is generally too time consuming and very tedious, especially considering access to petroleum engineering subject matter experts (SMEs) is often limited. Fully automatic labeling can also be problematic. For example, although the artificial lift system failure events are recorded in the artificial lift database, they are not suitable for direct use because of semantic differences in the interpretation of artificial lift system failure dates. The artificial lift system failure dates in the database do not correspond to the actual failure dates, or even to the dates when the SMEs first noticed the failures. Rather, the recorded failure dates typically correspond to the date when the workers shut down an artificial lift well to begin repairs. Because of the backlog of artificial lift system repair jobs, the difference can be several months between the actual failure dates and the recorded failure dates. Moreover, even if the exact failure dates are known, differentiation of the failures among normal, pre-failure and failure signals still needs to be performed.

FIG. 1 shows an example artificial lift system failure where several selected attributes collected through POC equipment are displayed. In particular, FIG. 1 illustrates peak surface load, surface card area, and the number of pumping cycles. As shown in FIG. 1, the failure of the artificial lift system was detected by field personnel on Mar. 31, 2010. After pulling all the pumping systems above the ground, it was discovered that there were holes on the tubing that caused leaking problems, which in turn, reduced the fluid load the rod pump carried to the surface. Through a "look back" process, subject matter experts determined "rod cut" events likely started as early as Nov. 25, 2009 where the rod began cutting the tubing. The problem grew worse over time, cutting large holes into the tubing. The actual leak likely started around Feb. 24, 2010. Therefore, the difference between the actual failure date and the recorded failure date was over a month.

There is a need for more automated systems, such as artificial intelligent systems that can dynamically keep track of certain parameters in each and every unit, give early indications or warnings of failures, and provide suggestions on types of maintenance work required based on the knowledge acquired from previous best practices. Such systems would be an asset to industry personnel by allowing them to be more proactive and to make better maintenance decisions. These systems would increase the efficiency of the pumping units and bring down Operating Expenditure (OPEX), thereby making pumping operations more economical.

SUMMARY

A method for failure prediction for artificial lift well systems is disclosed. The method comprises providing a production well associated with an artificial lift system and data indicative of an operational status of the artificial lift system. One or more features are extracted from the data. Data mining is applied to the one or more features to determine whether the artificial lift system is predicted to fail within a given time period. An alert is output indicative of impending artificial lift system failures.

In one or more embodiments, data preparation techniques are applied to the data prior to extracting the one or more features from the data.

In one or more embodiments, extracting the one or more features comprises using a sliding window approach to extract multiple multivariate subsequences.

In one or more embodiments, extracting the one or more features comprises extracting multiple multivariate subsequences based on medians of attributes.

In one or more embodiments, extracting one or more features comprises generating a multivariate time series, segmenting the multivariate time series into segments based on failure events, and applying a sliding window approach to extract multiple multivariate subsequences for each attribute within each of the segments.

In one or more embodiments, applying data mining to the features comprises constructing a training set comprising true positive events, iteratively adding false negative events into the training set until a converged failure recall rate is obtained, and adding false positives into the training set to increase failure precision while maintaining the failure recall rate.

In one or more embodiments, applying data mining to the features comprises clustering artificial lift systems to be tested into a first cluster and a second cluster, where the first cluster is larger than the second cluster, based on a class value. A centroid of the first cluster is labeled as a normal subsequences cluster. The centroid of the first cluster is added to a training set and the training set is utilized to obtain an operational prediction for each artificial lift system.

In one or more embodiments, applying data mining to the features comprises applying a support vector machine classifier.

In one or more embodiments, applying data mining to the features comprises applying a random peek semi-supervised learning technique.

A system for failure prediction for artificial lift well systems is also disclosed. The system comprises a database, a computer processor, and a computer program executable on the computer processor. The database is configured to store data from an artificial lift system associated with a production well. The computer program comprises a Data Extraction Module, a Feature Extraction Module, and a Failure Prediction Module. The Data Extraction Module is configured to extract data indicative of an operational status of the artificial lift system from the database. The Feature Extraction Module is configured to extract one or more features from the data indicative of the operational status of the artificial lift system. The Failure Prediction Module is configured to apply data mining to the one or more features to determine whether the artificial lift system is predicted to fail within a given time period.

In one or more embodiments, the computer program further comprises a Data Preparation Module configured to reduce noise in the data indicative of the operational status of the artificial lift system prior to the Feature Extraction Module extracting the one or more features.

In one or more embodiments, the Feature Extraction Module is further configured to extract multiple multivariate subsequences based on medians of attributes.

In one or more embodiments, the Feature Extraction Module is further configured to generate a multivariate time series, segment the multivariate time series into segments based on failure events, and apply a sliding window approach to extract multiple multivariate subsequences for each attribute within each of the segments.

In one or more embodiments, the Failure Prediction Module is further configured to construct a training set comprising true positive events, iteratively add false negative events into the training set until a converged failure recall rate is obtained, and add false positives into the training set to increase failure precision while maintaining the failure recall rate.

In one or more embodiments, the Failure Prediction Module is further configured to apply a random peek semi-supervised learning technique. Artificial lift systems to be tested are split into a first cluster and a second cluster, where the first cluster is larger than the second cluster, based on a class value. A centroid of the first cluster is labeled as a normal subsequences cluster. The centroid of the first cluster is added to a training set and the training set is utilized to obtain an operational prediction for each artificial lift system.

In one or more embodiments, the system further comprises a display that communicates with the Failure Prediction Module such that an alert indicative of an impending artificial lift system failure is produced on the display.

A non-transitory processor readable medium containing computer readable instructions for failure prediction for artificial lift well systems is also disclosed. The computer readable instructions comprise a Data Extraction Module, a Feature Extraction Module, and a Failure Prediction Module. The Data Extraction Module is configured to extract data indicative of an operational status of an artificial lift system from a database. The Feature Extraction Module is configured to extract one or more features from the data indicative of the operational status of the artificial lift system. The Failure Prediction Module is configured to apply data mining to the one or more features to determine whether the artificial lift system is predicted to fail within a given time period.

In one or more embodiments, the computer readable instructions further comprise a Data Preparation Module configured to reduce noise in the data indicative of the operational status of the artificial lift system prior to the Feature Extraction Module extracting the one or more features.

In one or more embodiments, the Feature Extraction Module is further configured to extract multiple multivariate subsequences based on medians of attributes.

In one or more embodiments, the Feature Extraction Module is further configured to generate a multivariate time series, segment the multivariate time series into segments based on failure events, and apply a sliding window approach to extract multiple multivariate subsequences for each attribute within each of the segments.

In one or more embodiments, the Failure Prediction Module is further configured to construct a training set comprising true positive events, iteratively add false negative events into the training set until a converged failure recall rate is obtained, and add false positives into the training set to increase failure precision while maintaining the failure recall rate.

In one or more embodiments, the Failure Prediction Module is further configured to apply a random peek semi-supervised learning technique. Artificial lift systems to be tested are split into a first cluster and a second cluster, where the first cluster is larger than the second cluster, based on a class value. A centroid of the first cluster is labeled as a normal subsequences cluster. The centroid of the first cluster is added to a training set and the training set is utilized to obtain an operational prediction for each artificial lift system.

BRIEF DESCRIPTION OF THE DRAWINGS

FIG. 6 shows a method for feature extraction, according to an embodiment of the present invention.

FIG. 8 shows a method for training selection, according to an embodiment of the present invention.

FIG. 9 shows a method for random peek semi-supervised learning, according to an embodiment of the present invention.

DETAILED DESCRIPTION

Embodiments of the present invention relate to artificial lift system failures in oil field assets, which lead to production loss and can greatly increase operational expenditures. In particular, systems, methods, and computer program products are disclosed for analyzing and predicting the performance of artificial lift systems. Predicting artificial lift system failures can dramatically improve performance, such as by adjusting operating parameters to forestall failures or by scheduling maintenance to reduce unplanned repairs and minimize downtime. For brevity, the below description is described in relation to sucker rod pumps. However, embodiments of the present invention can be applied to other types of artificial lift systems including gas lift systems, hydraulic pumping units, electric submersible pumps (ESPs), progressive cavity pumps (PCPs), and plunger lift systems.

Embodiments of the present invention utilize artificial intelligence (AI) techniques and data mining techniques. As will be described in more detail herein, a prediction framework and associated algorithms for artificial lift systems, such as rod pump systems, are disclosed. State-of-the-art data mining approaches are adapted to learn patterns of dynamical pre-failure and normal artificial lift time series records, which are used to make failure predictions. In some embodiments, a semi-supervised learning technique using "random peek" is utilized such that the training process covers more feature space and overcomes the bias caused by limited training samples in failure prediction. The failure prediction frameworks disclosed herein are capable of foretelling impending artificial lift system failures, such as rod pump and tubing failures, using data from real-world assets.

Figure 2:
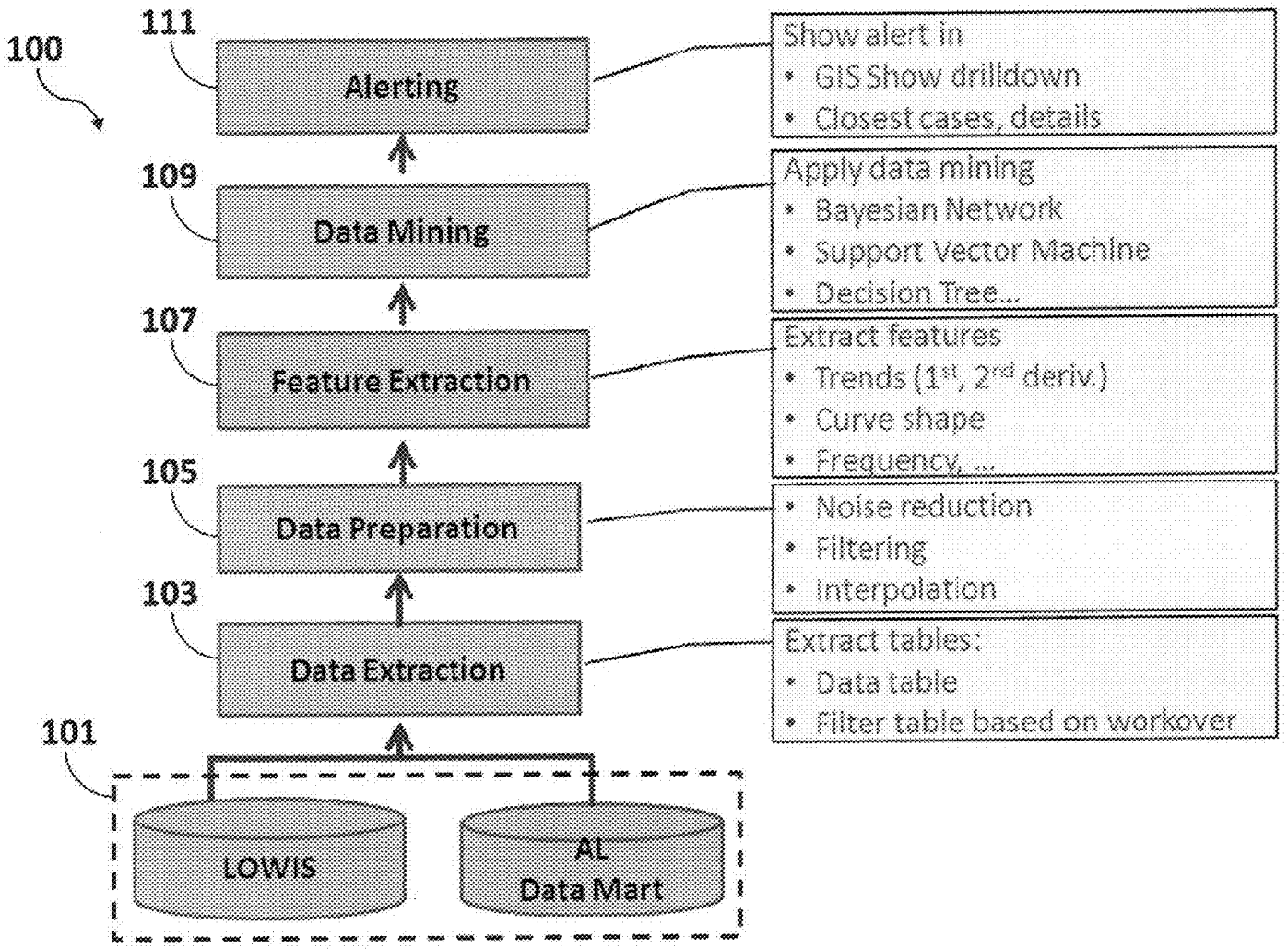
FIG. 2 is a flow diagram showing a method for analyzing and predicting the performance of artificial lift systems, according to an embodiment of the present invention.

FIG. 2 shows method 100 for failure prediction according to embodiments of the present invention. In step 101, data is stored in one or more databases or system of records (SORs). In step 103, data used for failure prediction is extracted, such as into data tables. Data preparation is performed in step 105 to address the problem of noise and missing values. In step 107, the de-noised data is transformed into feature data. In some embodiments, feature extraction is performed using a sliding window technique. In step 109, data mining is performed. The can include applying learning algorithms to train, test and evaluate the results in the data mining stage. Embodiments of the present invention utilize semi-supervised learning. In semi-supervised learning, only part of the training dataset is labeled and the training set is used to improve the performance of the model. In step 111, the system outputs failure predictions. For example, failure predictions can be visual alerts providing one or more warnings of impending failures.

Data Collection/Storage

To perform failure prediction, data is first collected in step 101 of method 100 for artificial lift systems of interest. For example, data can be collected from pump off controllers (POCs), which gather and record periodic artificial lift sensor measurements. These measurements, which are indicative of production and artificial lift system status, are obtained through load cells, motor sensors, pressure transducers and relays located at the surface of the well or downhole. In general, POCs monitor work, or other related information, performed by the artificial lift system. For example, such work for sucker rod pumps can be described as a function of the polished rod position. In particular, a plot of polished rod load versus polished rod position as measured at the surface can be produced. For a normally operating pump, this plot, which is commonly referred to as a "surface card" or "surface dynagraph," is generally shaped as an irregular elliptical profile. The area bounded by this irregular elliptical profile, often referred to as the surface card area, is proportional to the work performed by the pump. Many POCs utilize a surface card area plot to determine when the sucker rod pump is not filling in order to shutdown the pump for a time period. Other attributes that can be recorded using POCs include peak surface load, minimum surface load, average surface load, strokes per minute, surface stroke length, flow line pressure, pump fillage (the proportion that a pump is filled at each stroke), the number of cycles and run time. Additionally, gearbox (GB) torque, polished rod horse power (PRHP), and net downhole (DH) pump efficiency can also be calculated.

These attributes are typically measured daily, sent over a wireless network, and recorded in one or more databases or system of records (SORB). For example, these attributes can be stored in databases such as artificial lift system data marts or LOWIS™ (Life of Well Information Software), which is available from Weatherford International Ltd. Attribute values can be indexed in the database(s) by an artificial lift system identifier and a date. In addition to these daily measurements, field specialists can perform intermittent field tests and enter the field test results into the database(s). These attributes can include last approved oil, last approved water, and fluid level. Since these attributes are generally nut measured daily, the missing daily values can be automatically populated with the most recent measurement such that these attribute values are assumed to be piecewise constants. Together these attributes define a labeled multivariate time series dataset for an artificial lift system. An additional attribute called "class" can also be added in the database(s) that represent the daily operational status of the artificial lift system. For example, the class attribute can index the artificial lift system as performing normally, being in a pre-failure stage, or as failed.

The attributes can be partitioned into a plurality of attribute groups and ranked according to one or more metrics. For example, the attribute groups can be divided into groups based on relevancy to failure predication, data quality, or a combination thereof. In one embodiment, the attributes are divided into the following three groups, where group A is the most relevant and has the highest data quality.

A. Surface card area, peak surface load, minimum surface load, number of cycles run in the previous day (yesterday cycles), and daily run time.

B. Strokes per minute, pump Pillage, calculated GB torque, PRHP-IP, net DH pump efficiency, gross fluid rate (sum of last approved oil and water), and flow line pressure.

C. Surface stroke length.

Data Extraction

In step 103, data extraction provides software connectors capable of extracting any of the stored data from the artificial lift databases and feeding it to the prediction system. For example, this can be achieved by running a SQL query on the database, such as LOWIS™ or an artificial lift data mart, to extract the attributes in the form of time series for each artificial lift system. In some embodiments, attributes are extracted in data tables such as workover filter tables and beam analysis tables.

Data Preparation

Raw artificial lift time series data typically contains noise and faults, which can be attributed to multiple factors. For example, severe weather conditions, such as lighting strikes, can disrupt communication causing data to be dropped. Transcription errors may occur if data is manually entered into the system. This noisy and faulty data can significantly degrade the performance of data mining algorithms. Data preparation reduces this noise. An example of a noise reduction technique includes using the Grubbs's test to detect outliers and applying a locally weighted scatter plot smoothing algorithm to smooth the impact of the outliers. Other noise reduction techniques known in the art can alternatively be applied.

Figure 3A:
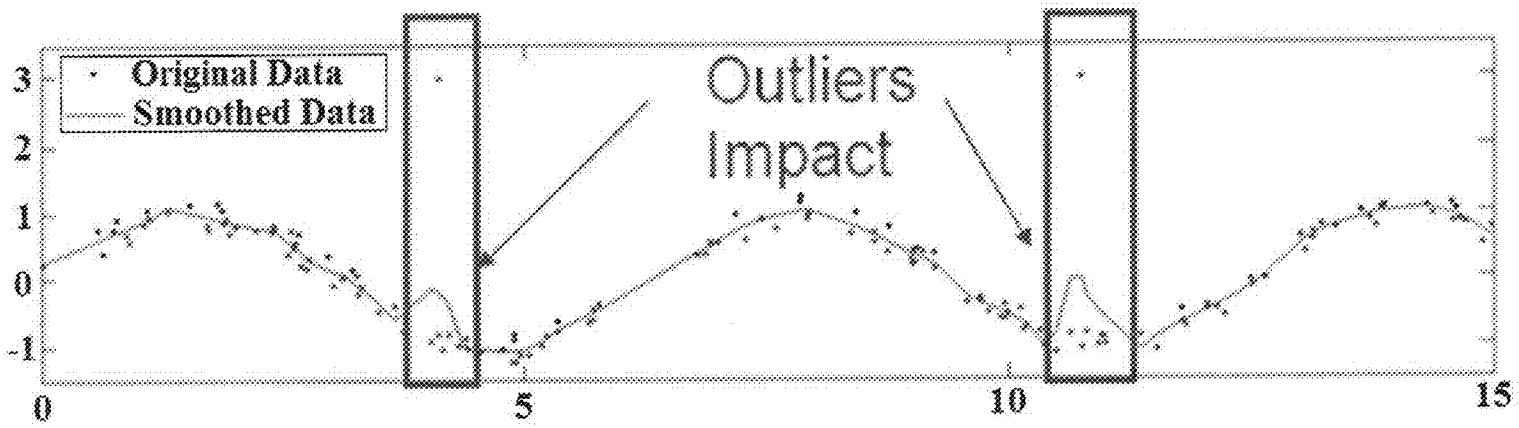
FIG. 3 shows the results of applying data preparation to an example dataset, according to an embodiment of the present invention.
Figure 3B:
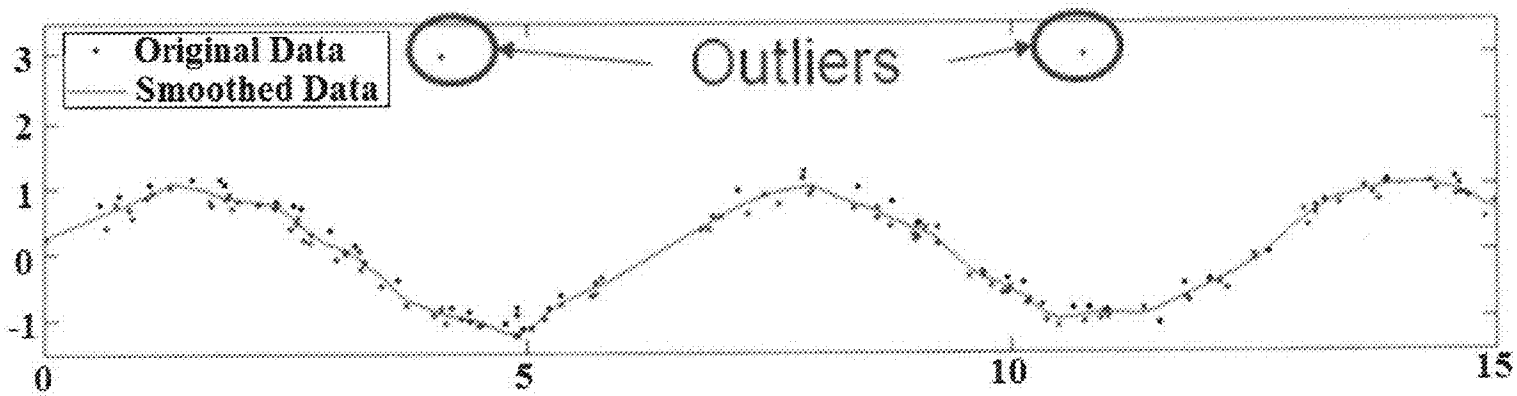

FIG. 3 illustrates the impact of outliers on a dataset. The results before (FIG. 3A) and after (FIG. 3B) show the smoothing process using linear regression on artificial data points where random Gaussian noise and two outliers were added. As shown in FIG. 3A, the two outliers bias the curve introducing two local peaks, which in fact do not exist. After the outliers were identified and removed (FIG. 3B), the same regression algorithm is able to recover the original shape of the curve.

Feature Extraction

Each artificial lift system is characterized by multiple attributes, where each attribute by itself is a temporal sequence. This type of dataset is called a multivariate time series. For example, methods that can be used for feature extraction include those described by Li Wei and Eamonn Keogh at the 12th ACM SIGKDD international conference on knowledge discovery and data mining (Li Wei, Eamonn J. Keogh: Semi-supervised time series classification. KDD 2006: 748-753), which is incorporated herein by reference in its entirety.

In one or more embodiments, the data type of interest is a multivariate time series $T=t_1, t_2, \ldots, t_m$ comprising an ordered set of in variables. Each variable $t_i$ is a k-tuple, where each tuple $t_i=t_{i1}, t_{i2}, t_{i3}, \ldots, t_{ik}$ contains k real-values.

As used herein, a multivariate time series refers to the data for a specific artificial lift well. Data miners are typically not interested in any of the global properties of a whole multivariate time series. Instead, the focus is on deciding which subsection is abnormal. Therefore, if given a long multivariate time series per artificial lift well, every artificial lift well's record can be converted into a set of multivariate subsequences. In particular, given a multivariate time series T of length m, a multivariate subsequence $C_p$ is a sampling of length $w<m$ of contiguous position from T, that is, $C_p=t_p, t_{p+1}, \ldots, t_{p+w-1}$ for $1 \le p \le m-w+1$.

Figure 4:
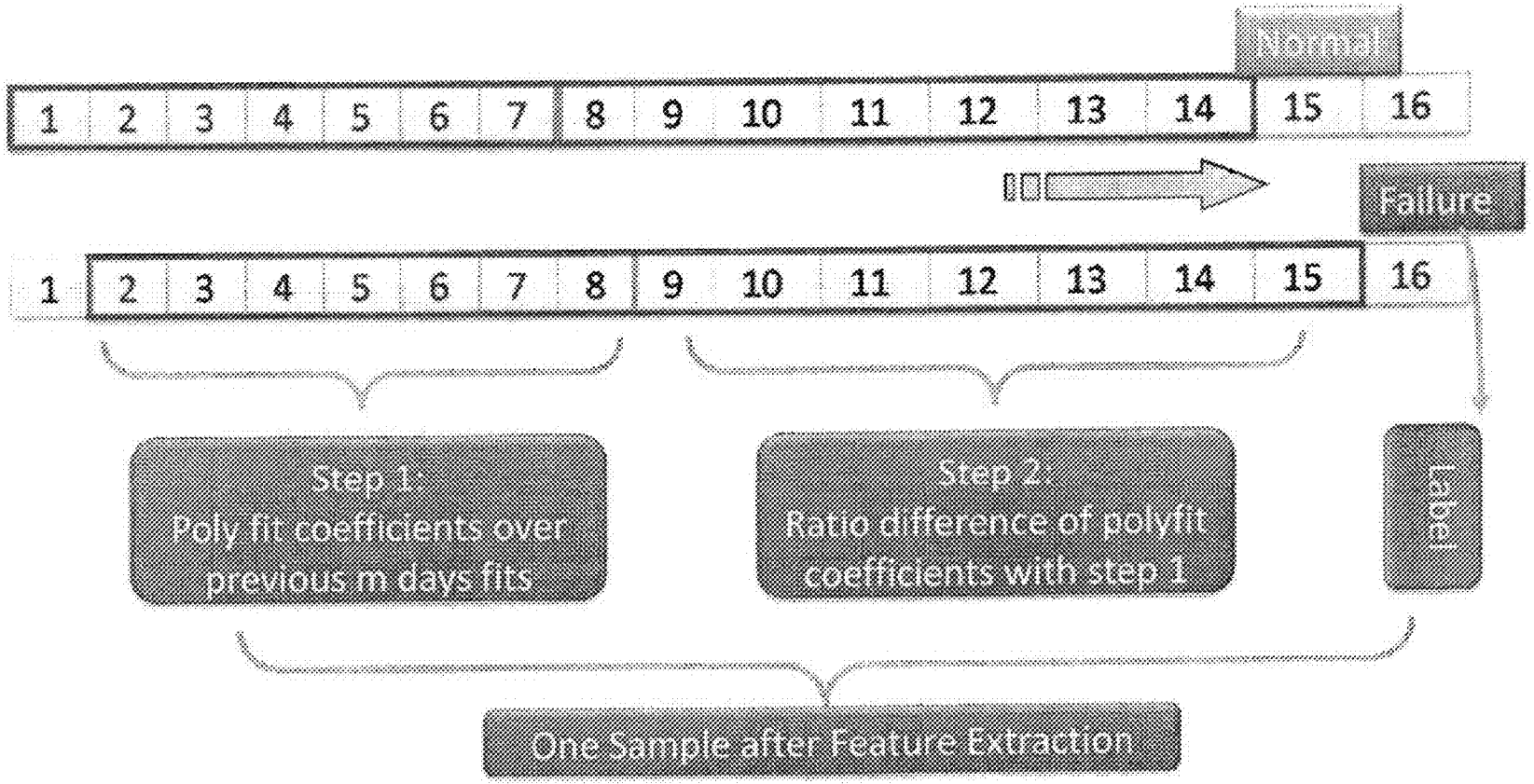
FIG. 4 shows a sliding window approach used for feature extraction, according to an embodiment of the present invention.
Figure 5A:
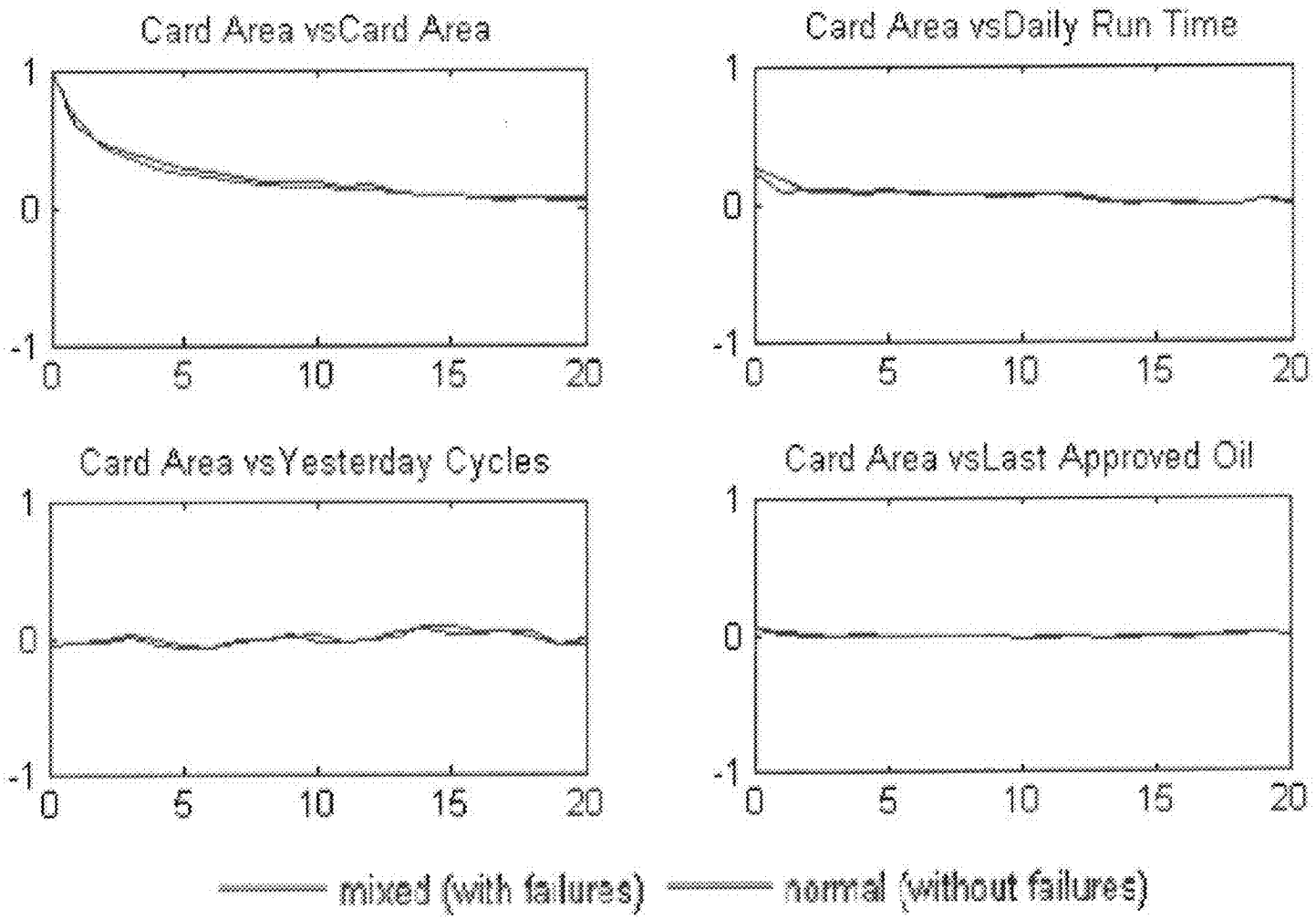
FIGS. 5A-5D show correlation analysis for card area (5A), daily run time (5B), yesterday cycles (5C) and last approved oil (5D) attributes, according to embodiments of the present invention.
Figure 5B:
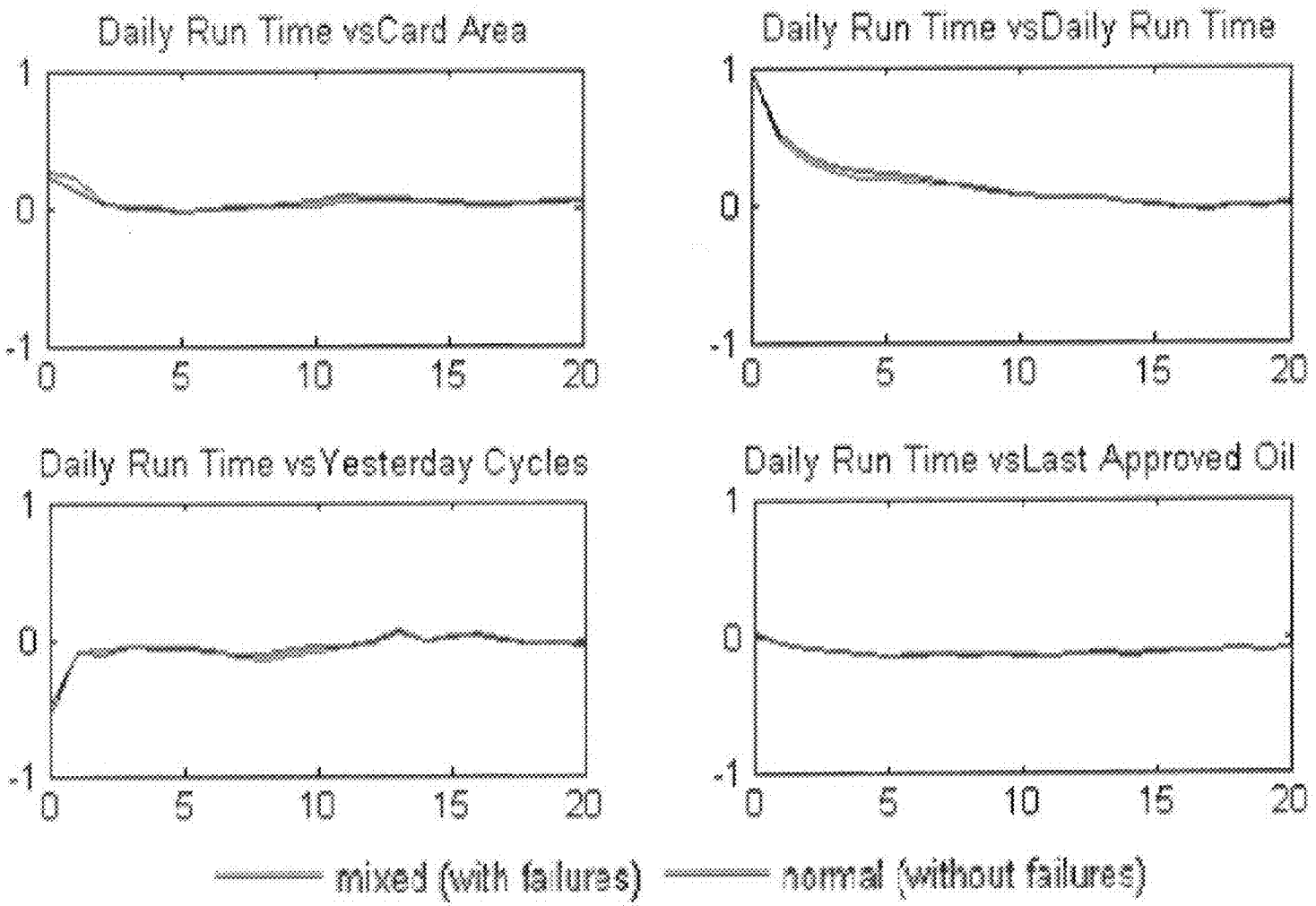
Figure 5C:
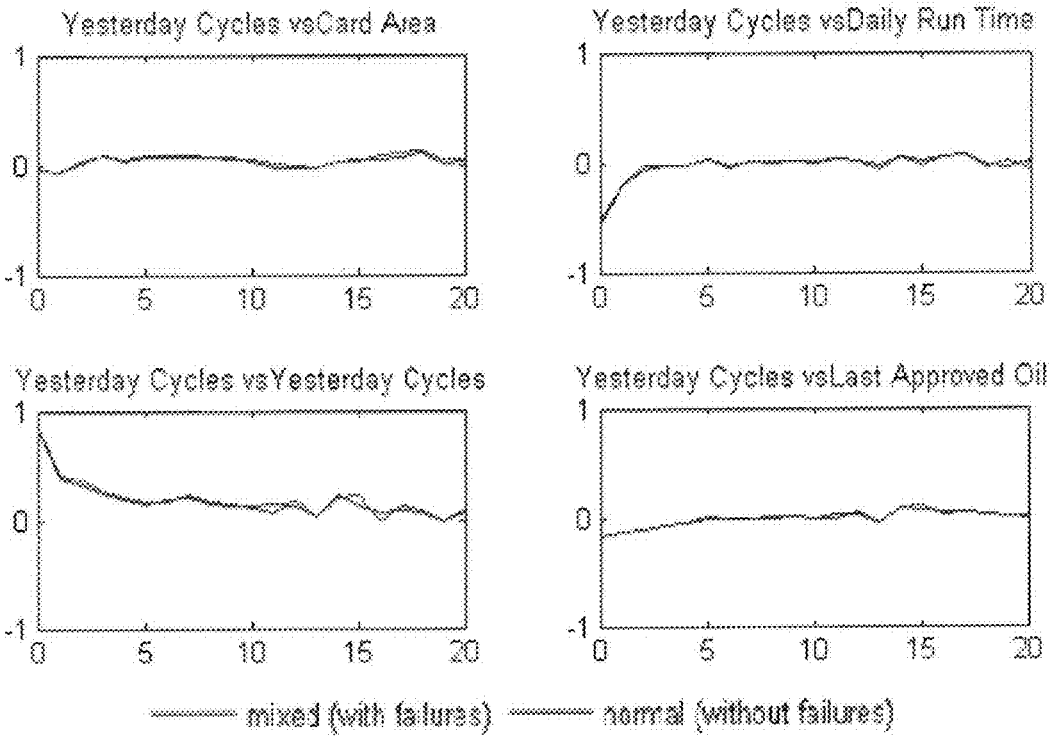
Figure 5D:
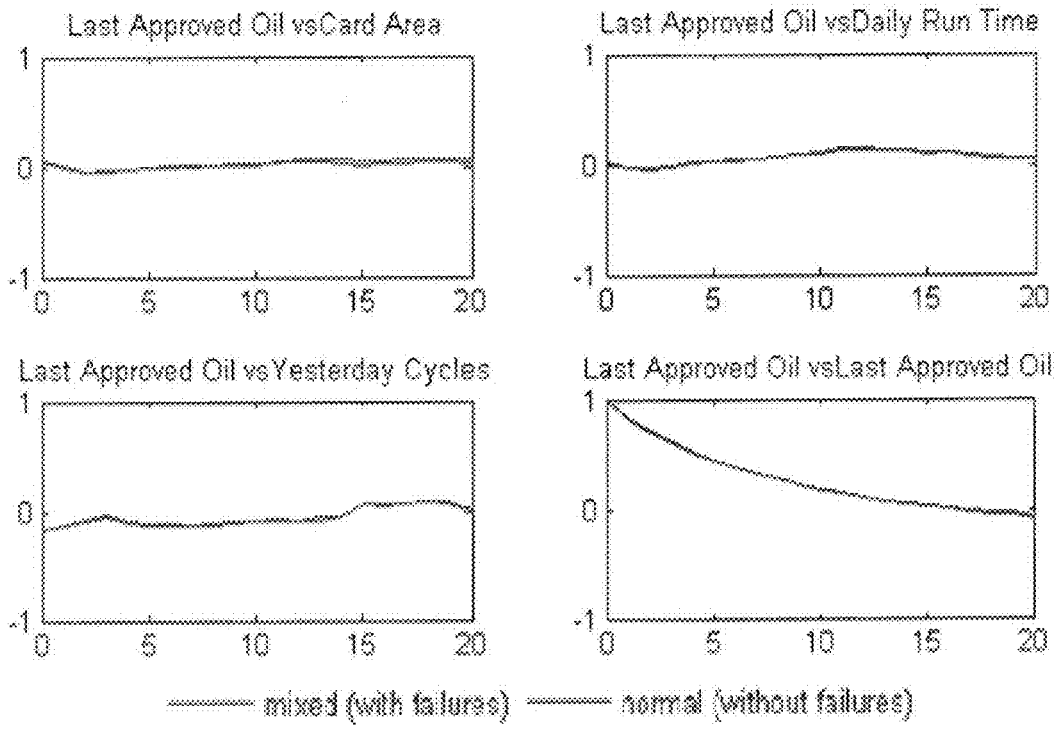

FIG. 4 depicts an example of feature extraction using a sliding window approach, which is used here to extract multiple multivariate subsequences. For example, for a multivariate time series T of length m and a user-defined multivariate subsequence length of w, subsequences can be extracted by sliding a window of size w across time series T and extracting each possible subsequence.

An appropriate subsequence sampling length w should be determined. If w is too small, the subsequences can fail to capture enough trend information to aid in failure prediction. If w is too large, the subsequences can contain extraneous data that hinders the performance of the data mining algorithms. Highly dimensional data are well known to be difficult to work with. In addition, highly dimensional data may incur large computational penalties. To estimate an appropriate sampling length w, the dependency between attributes across time and the dependency between an attribute's current value with its prior values are determined. To determine the dependency between attributes across time, cross-correlation analysis can be applied. For a multivariate time series T of k attributes, cross-correlation is a measure of similarity of two attributes' sequences as a function of time-lag $\tau$ applied to one of them. To determine the dependency between an attribute's current value with its prior values, autocorrelation can be applied. For a single time series T, autocorrelation is the cross-correlation with itself.

FIG. 5 illustrates correlation analysis among a subset of four attributes from an example dataset: card area (5A), daily run time (5B), yesterday cycles (5C), and last approved oil (5D). The x-axis in FIGS. 5A-5D represents the time-lag $\tau$. For example, a value of ten (10) correlates attribute A with attribute B ten (10) days later. The y-axis represents the correlation, where a higher correlation value is representative of attributes being more correlated. Attributes plotted against themselves (i.e., Card Area vs. Card Area, Daily Run Time vs. Daily Run Time, Yesterday Cycles vs. Yesterday Cycles, and Last Approved Oil vs. Last Approved Oil) are autocorrelations, whereas attributes plotted against other attributes show cross-correlations.

The plots in FIG. 5 indicate pairwise attributes rapidly becoming uncorrelated as a function of time lag $\tau$. The autocorrelation decreased to below 20% for attributes that correlate within 12 days. Additionally, the first 3 days preserve Over 70% of the correlation. Even with a fixed w, these subsequences still have high dimensionality –w×k. The dimensionality of the subsequences can be reduced by performing feature extraction. For a multivariate time series subsequence $C_p$ of length w, feature $f_p$ of $C_p$ can be obtained by constructing combinations of the high dimensional w×k space into a 1×n feature vector, where n<w×k, while still preserving its relevant characteristics.

There are many different methods for feature extraction, such as principle component analysis, isomap, locally linear embedding, wavelet, as well as, simple linear combinations such as statistical mean, median, and variance. There are also domain-specific approaches in time series feature extraction, such as event related potential (ERP) in neuroscience and Discrete Fourier Transform (DFT) in signal processing. Generally, feature sets should:

Reflect the nature of the data such that it is robust, reliable and time invariant;

Capture critical relevancy to perform desired tasks such that it is feasible to predict failures; and Reduce dimensionalities.

Subject matter experts utilize dynamometer cards, which show the dynamic relationship between load and stroke length, to analyze the performance trends of artificial lift systems. In one embodiment, information from dynamometer cards, such as surface card area, peak surface load and minimum surface load, are extracted for use. For example, the domain system can record one dynamometer card per day per artificial lift system, which provides a set of values for each specific artificial lift system per day that can be used as a representation of the performance for the entire clay. The short-term and long-term performance of the artificial lift system including its daily runtime and pumping cycles can also be used for trend analysis.

Figure 1:
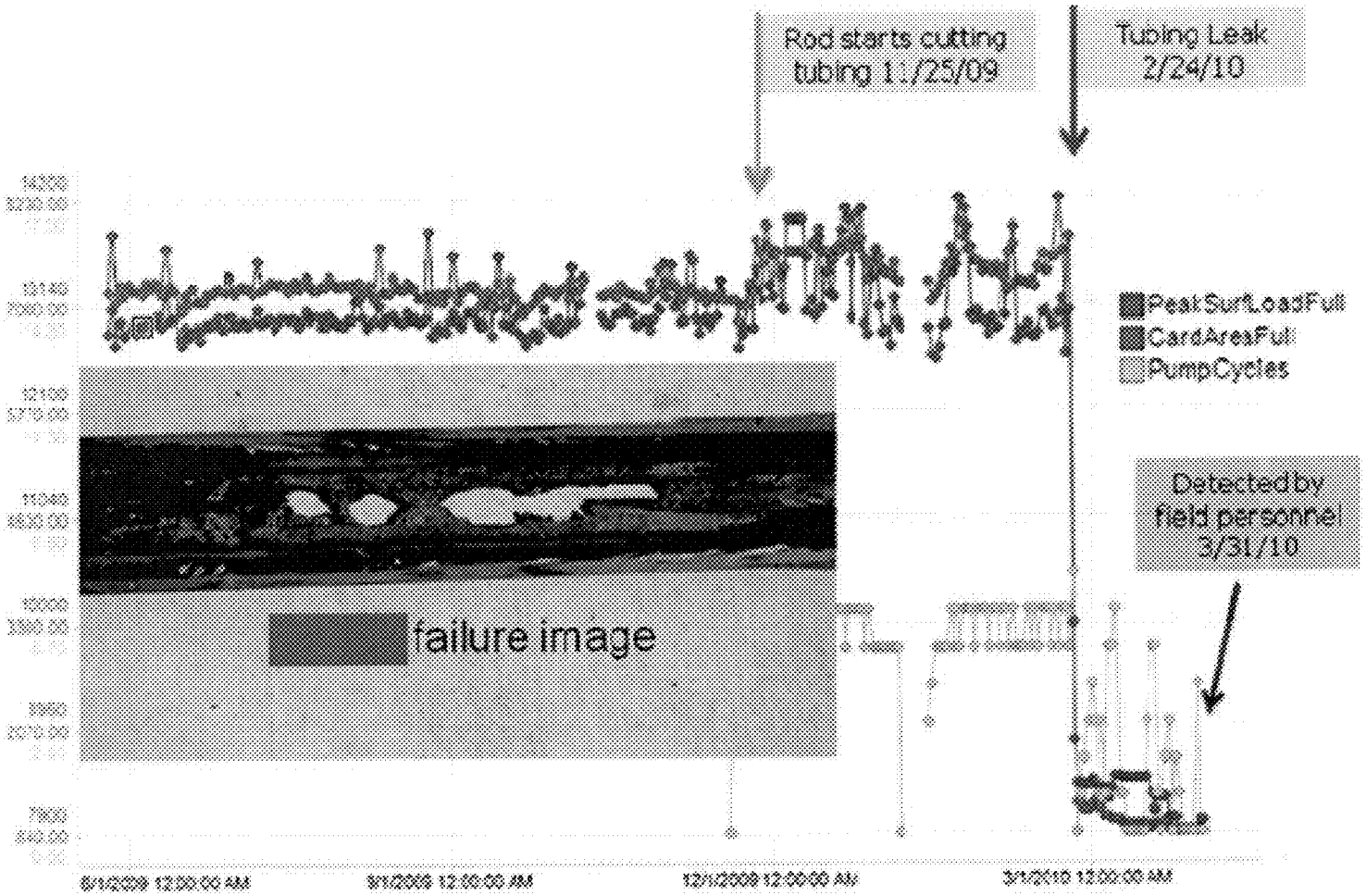
FIG. 1 shows an example artificial lift failure and a corresponding failure pattern.

After collecting raw daily data, which changes frequently and does not follow any obvious stochastic process patterns, a feature extraction algorithm can be used to extract trending information that best represents artificial lift system failures. For example, based on domain knowledge, when a tubing failure (e.g., a tubing leak) occurs, it causes significant drop in the load of fluid pumped to the surface. Such information produces a failure pattern, such as the pattern described in FIG. 1. Other types of failures follow different trending patterns.

In one embodiment, trends are represented by using medians. For example, a global trend and local trend are useful to determine the amount a trend changes. To capture both long-term and short-term trends, multiple subsequences within a single sliding window can be utilized. For example, bigger sized subsequences can be used for capturing global trends while smaller sized subsequences can be used for capturing local trends.

FIG. 6 shows an algorithm that describes feature extraction logic according to an embodiment of the present invention. The configuration of an artificial lift well might change after each failure event and therefore, it is unreasonable to consider correlation from two different configurations that might infer different behaviors. Accordingly, each artificial lift well's records are initially segmented by the failure events. If there is an event, the feature extraction therefore does not cross between two configurations, which later might cause inconsistency issues. A robust statistical attribute median is used for performing the dimension reduction task such that it is not biased by spikes.

Labeling Methodology

Datasets, such as those obtained from POCs, are not explicitly labeled. As previously described, automatic labeling is problematic because of the difficulty in determining when the failure occurred and manual labeling is problematic due to the limited availability of subject matter experts.

In an embodiment of the present invention, a machine assisted labeling methodology is used in which the system suggests potential labeling that is then verified by SMEs. In particular, clustering is used to provide an initial labeling, which is then refined by SMEs. Here, the clustering is applied to individual artificial lift wells, and not across them (e.g. clustering among two artificial lift wells). Clustering across artificial lift wells tends to generate uninteresting clusters that do not relate to failures due to the variation across artificial lift wells being large. Several clustering techniques can be applied to label the multivariate time series data. For example, clustering that considers all the attributes as relevant can be performed, such as by using an expectation-maximization (EM) algorithm. An EM algorithm assumes that the data is formed based on hidden Gaussian mixtures. In this case, it is assumed that each Gaussian distribution represents a failure stage—normal, pre-failure, or failure.

Here, the observed data is $F_i$, which is a whole failure case from normal to its specific failure date, having log-likelihood $l(\theta; f_i; Z_i)$ depending on parameters $\theta=\{\theta_{normal}, \theta_{pre\text{-}failure}, \theta_{failure}\}$, which more specifically reflects the parameters of three unknown joint Gaussian distributions. In the log-likelihood, $Z_i$ represents the latent data or missing values, which is the assignment of each record in $F_i$ with respect to the three distributions. Thus, such a labeling process can be formulated as a maximum likelihood estimation problem, which can be done using the following EM procedure.

E step: compute $$Q(\theta'|\theta^i)=^E(l(\theta';F_i;Z_i))$$

as a function of the dummy argument $\theta'$

M step: determine the new estimate $\theta^{i+1}$ using:

$$\theta^{i+1} = \underset{\theta}{\operatorname{argmax}} Q(\theta \mid \theta^i)$$

The clustering results can then be correlated by considering timing information. The SMEs can then review the analysis to confirm or adjust the labels.

Figure 7:
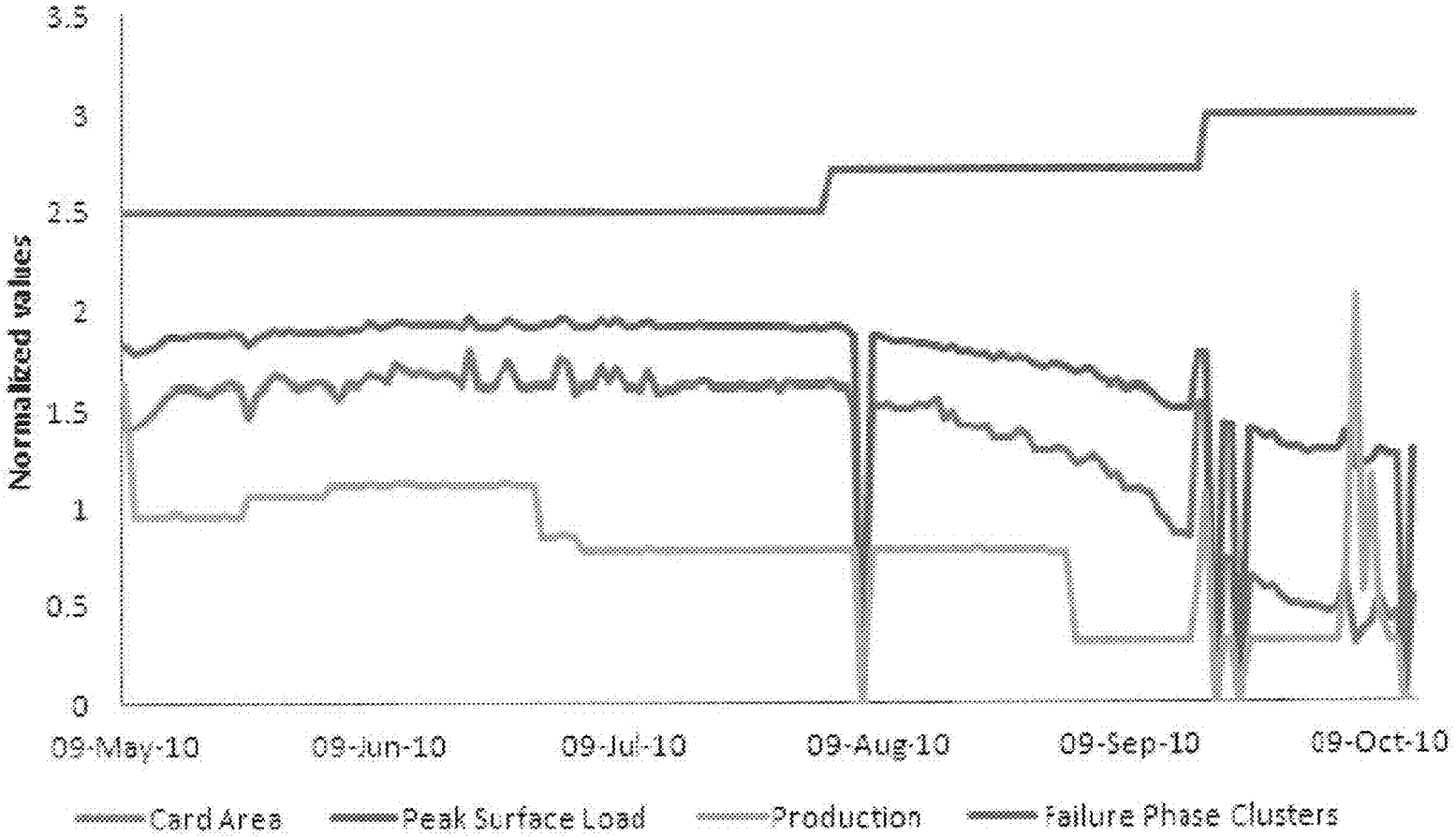
FIG. 7 shows an example of labeling using clustering, according to an embodiment of the present invention.

FIG. 7 shows an example of labeling using clustering. The failure range is identified with the help of clustering, which combines trends to distinguish among normal, pre-failure and failure signals. The trends are plotted using time information such that SMEs can confirm or adjust the labeling. Although the machine assisted labeling methodology greatly reduces the time required to perform labeling, the value provided by the SMEs can be further maximized using training.

Training Selection

Training selection focuses the labeling on a few artificial lift systems that have clear trending signals leading from normal, to pre-failure signal modes, and then to failure signal modes. The duration of these trending signals can sometimes last for more than a half of a year. In the training selection step, true positive (TP) events, true negative (TN) events, false positive (FP) events, and false negative (FN) events are identified. As used herein, a true positive (TP) event refers to a failure event that is predicted ahead of its recorded time. A true negative (TN) event refers to a normal artificial lift system that is not predicted with any failures. A false positive (FP) event is an artificial lift system that does not have any failures but is predicted with failures. A false negative (FN) event refers to an artificial lift system that has a failure but it was not predicted before it happened. Once artificial lift systems are suggested for training by the SMEs and they are labeled, such as by using machine assisted labeling, the training set can be constructed.

FIG. 8 shows a method that can be used for training selection. In this embodiment, an iterative bootstrapping process is used to enhance the training set such that the time typically needed for interacting with SMEs can be reduced. Here, the process starts with a small set of failure cases which have clear trending signals. False negative samples are iteratively added into the training set until a converged failure recall rate is obtained. For example, the convergence criteria can be controlled by $\delta$. In one embodiment, the training set is considered to be converged if a gain of 0.01 is not exceed when adding an optimal, such as by the argmax process. Once the maximum amount of failures can be predicted, false positives are introduced into the training set until the failure precision, TP/(TP+FP), is maximized, while still maintaining the failure recall level within an acceptable threshold. For example, in one embodiment, eighty percent (80%) represents an acceptable threshold. In another embodiment, ninety percent (90%) represents an acceptable threshold. However, the number of false positives is generally kept to a minimum during training. This is because for each alert, if a failure prediction is made, the artificial lift well is stopped for a full inspection, which involves costly labor and down time.

Machine Learning

In traditional supervised learning, data mining algorithms are provided positive and negative training examples of concepts for which the algorithms are supposed to learn. In particular, the training examples comprise pairs of inputs and desired outputs such that the learning algorithm can analyze the training examples and predict the corresponding output value for each input provided. For example, a failure prediction model can be generated based on an example training dataset, which includes an artificial lift multivariate time series with artificial lift system class labels. When provided previously unseen artificial lift datasets with multivariate time series, but no class values, the failure prediction model can predict class values for the artificial lift system. This type of learning is considered supervised learning because the class labels are used to direct the learning behavior of the data mining algorithm. As such, the resulting failure prediction model in traditional supervised learning formulations does not change with respect to artificial lift data from the training set.

In embodiments of the present invention, semi-supervised learning (SSL) is used to capture the individual knowledge of the training set for artificial lift systems. In semi-supervised learning only a small amount of samples are labeled and used to train the model. Regardless, the data mining algorithm still performs as if all the labels were provided. Furthermore, since each artificial lift system behaves differently than the other, it is generally impractical to be fully covered by all the training examples. Therefore, semi-supervised learning algorithms typically assume some prior knowledge about the distribution of the dataset that is able to help increase the accuracy.

Figure 10:
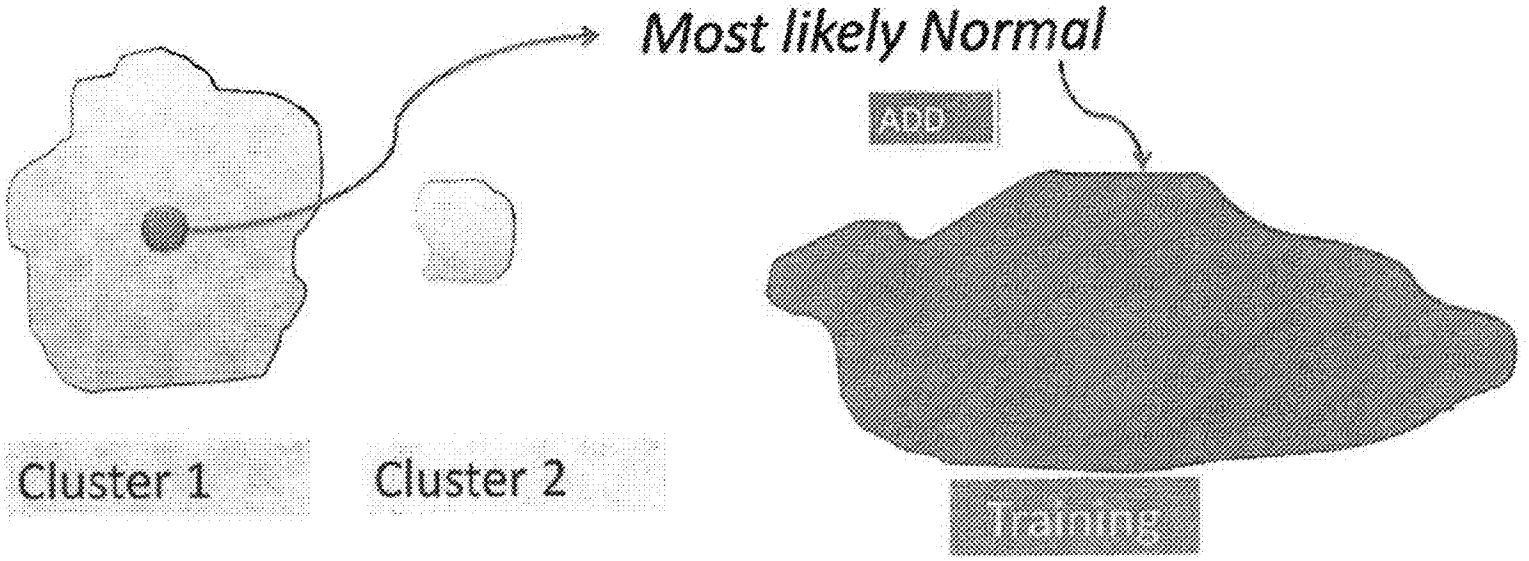
FIG. 10 shows a schematic for clustering using random peek semi-supervised learning, according to an embodiment of the present invention.

FIGS. 9 and 10 illustrate a method called random peek semi-supervised learning, according to embodiments of the present invention. In this method, data is split into clusters in the feature space based on a class value. Considering artificial lift systems function under normal conditions most of the time and failures are less likely events (e.g., for approximately 350 artificial lift systems observed for a period of 480 days, less than 70 failures occurred), the majority of unlabeled samples should be normal. Thus, if two clusters are defined, the larger cluster is labeled as the normal subsequences cluster. However, the smaller cluster does not necessarily represent failure cases as not all artificial lift systems have failures. The centroid of the larger cluster is added to a training set and the training set is utilized to obtain an operational prediction on individual artificial lift systems. Its random peck helps tune the classification boundaries by learning its "normal" behavior.

Evaluation

Evaluation is directed towards predicting failures rather than normal operation. This helps addresses the problem of failure dates that are not accurately recorded. Additionally, even if a false positive event is predicted, there is no way to be certain that it is a truly false prediction as it could be indicative of a future failure. Maintaining a low false failure alert rate (high precision and recall for failures) is therefore beneficial.

Figure 11:
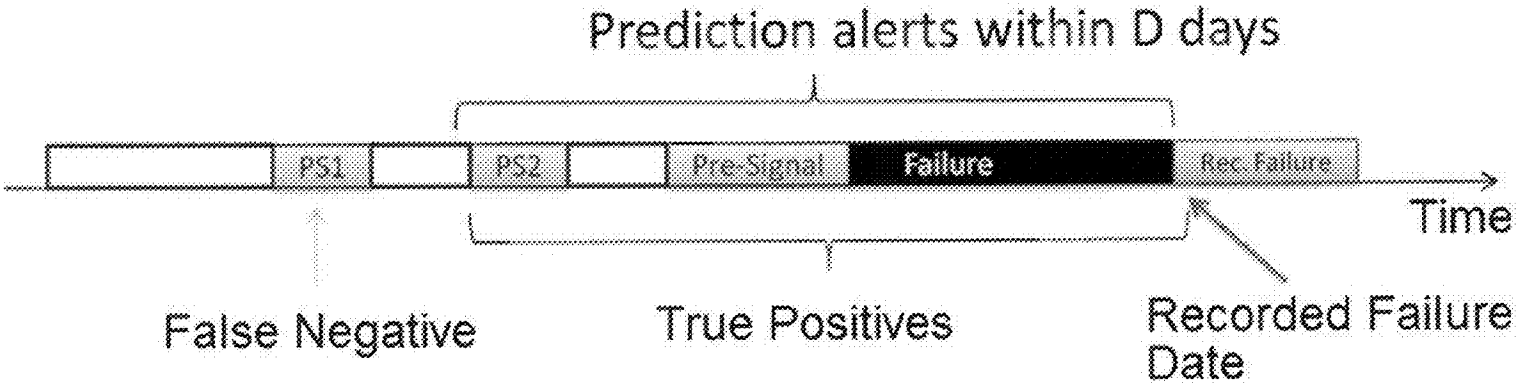
FIG. 11 shows a schematic of a failure pattern, according to an embodiment of the present invention.

FIG. 11 illustrates an example failure evaluation. In FIG. 11, the "recorded failure date" represents the date when a field specialist first detected the failure and recorded it in the database. The "Failure" box represents the period from when the true failure began up until it was recorded. The "Pre-Signal," "PS1" and "PS2" boxes represents periods when pre-failure signals existed. The white or empty boxes represent normal run time where there are no failure or pre-failure signals. In evaluation, a failure prediction is considered to be true only if it is within D days from the recorded failure date. In one embodiment, time period D represents 7 days. In another embodiment, time period D represents 14 days. In another embodiment, time period D represents 50 days. In another embodiment, time period D represents 100 days. This process is performed for each artificial lift system. As previously discussed, true positive events represent artificial lift systems where failures were successfully predicted. False positive events represent normal artificial lift systems that have failure alerts indicated. False negative events represent the artificial lift systems that have failures not predicted ahead of time or at all. True negative events represent normal artificial lift systems that have no failures predicted.

Those skilled in the art will appreciate that the above described methods may be practiced using any one or a combination of computer processing system configurations, including, but not limited to, single and multi-processor systems, hand-held devices, programmable consumer electronics, mini-computers, or mainframe computers. The above described methods may also be practiced in distributed or parallel computing environments where tasks are performed by servers or other processing devices that are linked through one or more data communications networks. For example, the large computational problems can be broken down into smaller ones such that they can be solved concurrently—or in parallel. In particular, the system can include a cluster of several stand-alone computers. Each stand-alone computer can comprise a single core or multiple core microprocessors that are networked through a hub and switch to a controller computer and network server. An optimal number of individual processors can then be selected for a given problem.

As will be described, the invention can be implemented in numerous ways, including for example as a method (including a computer-implemented method), a system (including a computer processing system), an apparatus, a computer readable medium, a computer program product, a graphical user interface, a web portal, or a data structure tangibly fixed in a computer readable memory. Several embodiments of the present invention are discussed below. The appended drawings illustrate only typical embodiments of the present invention and therefore, are not to be considered limiting of its scope and breadth.

Figure 12:
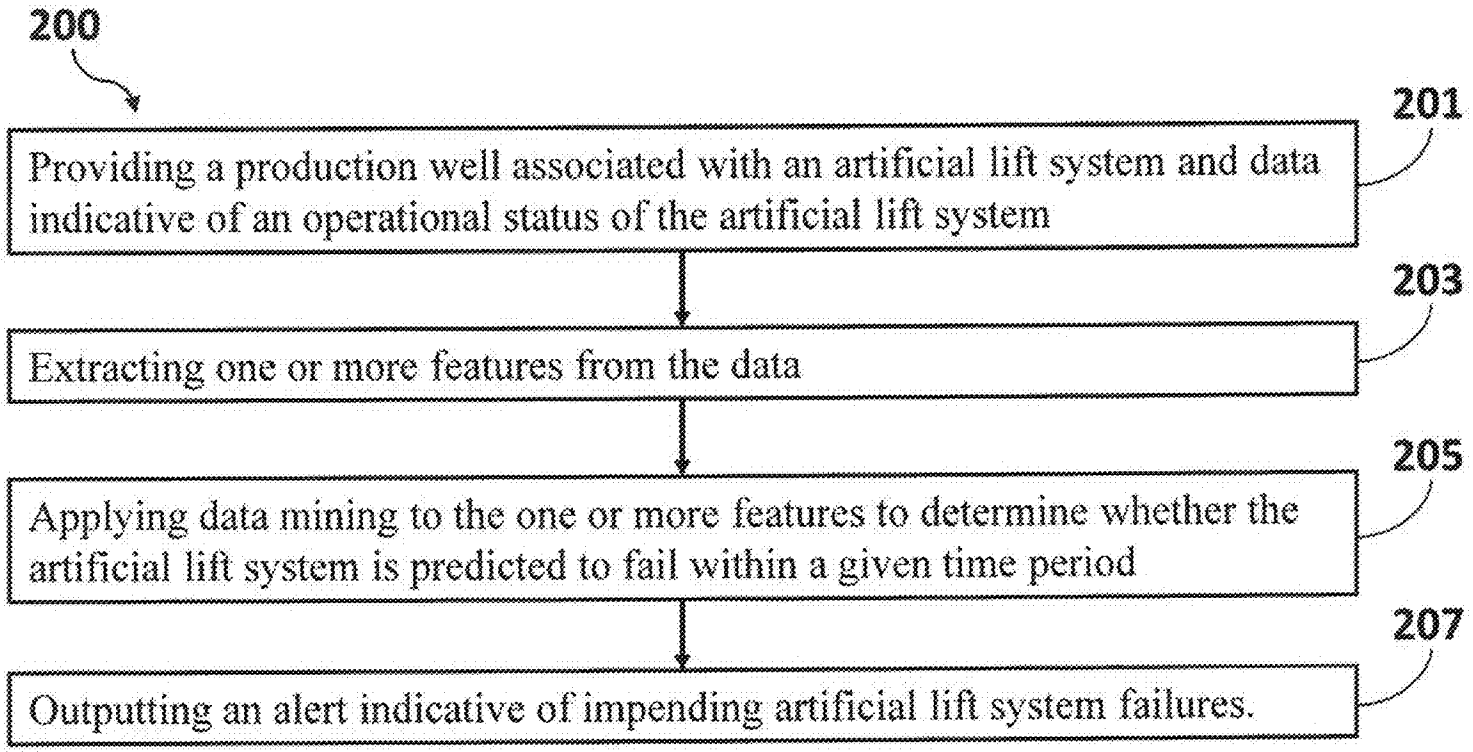
FIG. 12 shows a method for analyzing and predicting the performance of artificial lift systems, according to an embodiment of the present invention.

FIG. 12 depicts a flow diagram of an example computer-implemented method 200 for failure prediction for artificial lift well systems. A production well associated with an artificial lift system and data indicative of an operational status of the artificial lift system are provided in step 201. In step 203, one or more features are extracted from the data. In step 205, data mining is applied to the one or more features to determine whether the artificial lift system is predicted to fail within a given time period. An alert indicative of impending artificial lift system failures is output in step 207. For example, the alert can be image representations that are displayed or output to the operator.

Figure 13:
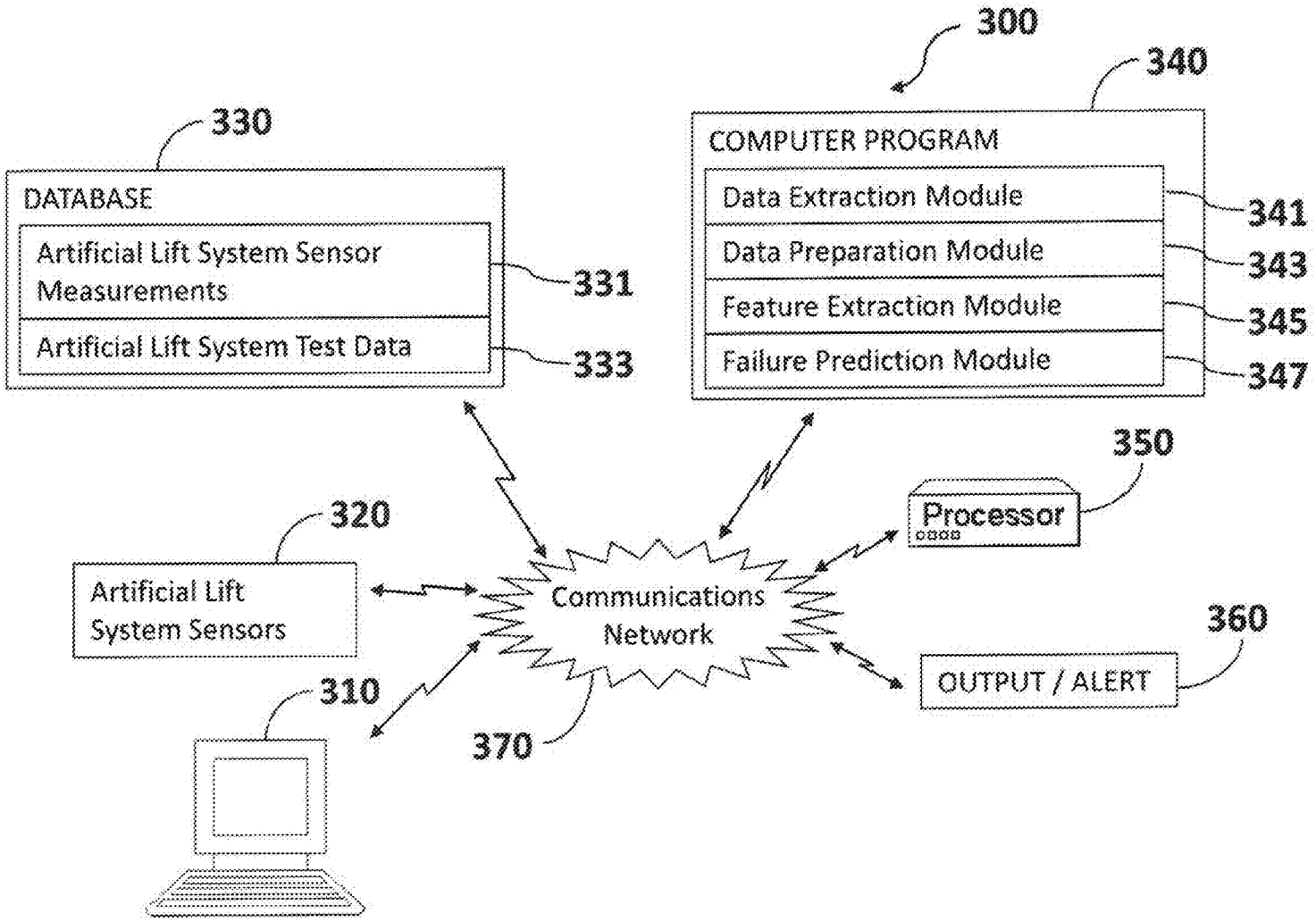
FIG. 13 shows a system for analyzing and predicting the performance of artificial lift systems, according to an embodiment of the present invention.

FIG. 13 illustrates an example computer system 300 for failure prediction for artificial lift well systems, such as by using the methods described herein, including the methods shown in FIGS. 2, 6, 8, 9, and 12. System 300 includes user interface 310, such that an operator can actively input information and review operations of system 300. User interface 310 can be any means in which a person is capable of interacting with system 300 such as a keyboard, mouse, or touch-screen display. In some embodiments, user interface 310 embodies spatial computing technologies, which typically rely on multiple core processors, parallel programming, and cloud services to produce a virtual world in which hand gestures and voice commands are used to manage system inputs and outputs.

Operator-entered data input into system 300 through user interface 310, can be stored in database 330. Measured artificial lift system data such as from POCs, which is received by one or more artificial lift system sensors 320, can also be input into system 300 for storage in database 330. Additionally, any information generated by system 300 can also be stored in database 330. Accordingly, database 330 can store user-defined parameters, measured parameters, as well as, system generated computed solutions. Database 330 can store, for example, artificial lift systems sensor measurements 331, which are indicative of operational statuses of artificial lift systems, obtained through load cells, motor sensors, pressure transducers and relays. Data recorded by artificial lift system sensors 320 can include, for example, surface card area, peak surface load, minimum surface load, strokes per minute, surface stroke length, flow line pressure, pump fillage, yesterday cycles, and daily run time. Furthermore, GB torque, polished rod HP, and net DH pump efficiency can be calculated for storage in database 330. Artificial lift system test data 333, which can include last approved oil, last approved water, and fluid level, can also be stored in database 330.

System 300 includes software or computer program 340 that is stored on a non-transitory computer usable or processor readable medium. Current examples of such non-transitory processor readable medium include, but are not limited to, read-only memory (ROM) devices, random access memory (RAM) devices and semiconductor-based memory devices. This includes flash memory devices, programmable ROM (PROM) devices, erasable programmable ROM (EPROM) devices, electrically erasable programmable ROM (EEPROM) devices, dynamic RAM (DRAM) devices, static RAM (SRAM) devices, magnetic storage devices (e.g., floppy disks, hard disks), optical disks (e.g., compact disks (CD-ROMs)), and integrated circuits. Non-transitory medium can be transportable such that the one or more computer programs (i.e., a plurality of instructions) stored thereon can be loaded onto a computer resource such that when executed on the one or more computers or processors, performs the aforementioned functions of the various embodiments of the present invention.

Computer program 340 includes one or more modules to perform any of the steps or methods described herein, including the methods shown in FIGS. 2, 6, 8, 9, and 12. In some embodiments, computer program 340 is in communication (such as over communications network 370) with other devices configured to perform the steps or methods described herein. Processor 350 interprets instructions or program code encoded on the non-transitory medium to execute computer program 340, as well as, generates automatic instructions to execute computer program 340 for system 300 responsive to predetermined conditions. Instructions from both user interface 310 and computer program 340 are processed by processor 350 for operation of system 300. In some embodiments, a plurality of processors 350 is utilized such that system operations can be executed more rapidly.

Examples of modules for computer program 340 include, but are not limited to, Data Extraction Module 341, Data Preparation Module 343, Feature Extraction Module 345, and Failure Prediction Module 347. Data Extraction Module 341 is configured to provide software connectors Capable of extracting data from database 330 and feeding it to Data Preparation Module 343 or directly to Feature Extraction Module 345. Data Preparation Module 343 is configured to apply noise reduction techniques and fault techniques to the extracted data. Feature Extraction Module 345 is configured to transform the data into features and transform all the time series data into feature sets. Failure Prediction Module 347 is configured to apply learning techniques, such as random peek semi-supervised learning, to train, test and evaluate the results in the data mining stage, thereby providing failure predictions of the artificial lift system.

In certain embodiments, system 300 includes reporting unit 360 to provide information to the operator or to other systems (not shown). For example, reporting unit 360 can provide alerts to an operator or technician that an artificial lift system is predicted to fail. The alert can be utilized to minimize downtime of the artificial lift system or for other reservoir management decisions. Reporting unit 360 can be a printer, display screen, or a data storage device. However, it should be understood that system 300 need not include reporting unit 360, and alternatively user interface 310 can be utilized for reporting information of system 300 to the operator.

Communication between any components of system 300, such as user interface 310, artificial lift system sensors 320, database 330, computer program 340, processor 350 and reporting unit 360, can be transferred over communications network 370. Computer system 300 can be linked or connected to other, remote computer systems or measurement devices (e.g., POCs) via communications network 370. Communications network 370 can be any means that allows for information transfer to facilitate sharing of knowledge and resources, and can utilize any communications protocol such as the Transmission Control Protocol/Internet Protocol (TCP/IP). Examples of communications network 370 include, but are not limited to, personal area networks (PANs), local area networks (LANs), wide area networks (WANs), campus area networks (CANS), and virtual private networks (VPNs). Communications network 370 can also include any hardware technology or equipment used to connect individual devices in the network, such as by wired technologies (e.g., twisted pair cables, co-axial cables, optical cables) or wireless technologies (e.g., radio waves).

In operation, an operator initiates software 340, through user interface 310, to perform the methods described herein, such as the methods shown in FIGS. 2, 6, 8, 9, and 12. Data Extraction Module 341 extracts data indicative of an operational status of the artificial lift system from database 330 and feeds it to Data Preparation Module 343 or directly to Feature Extraction Module 345. In some embodiments, Data Preparation Module 343 is used to apply noise reduction techniques and fault techniques to the extracted data. Feature Extraction Module 345 transforms the data into features and transforms the time series data into feature sets. Failure Prediction Module 347 applies data mining to the features to determine whether the artificial lift system is predicted to fail within a given time period. For example, Failure Prediction Module 347 can apply learning techniques, such as random peek semi-supervised learning, to train, test and evaluate the results in the data mining stage, thereby providing failure predictions of the artificial lift system. An alert indicative of impending artificial lift system failures is output or displayed to the operator.

NUMERICAL EXAMPLES

Figure 14:
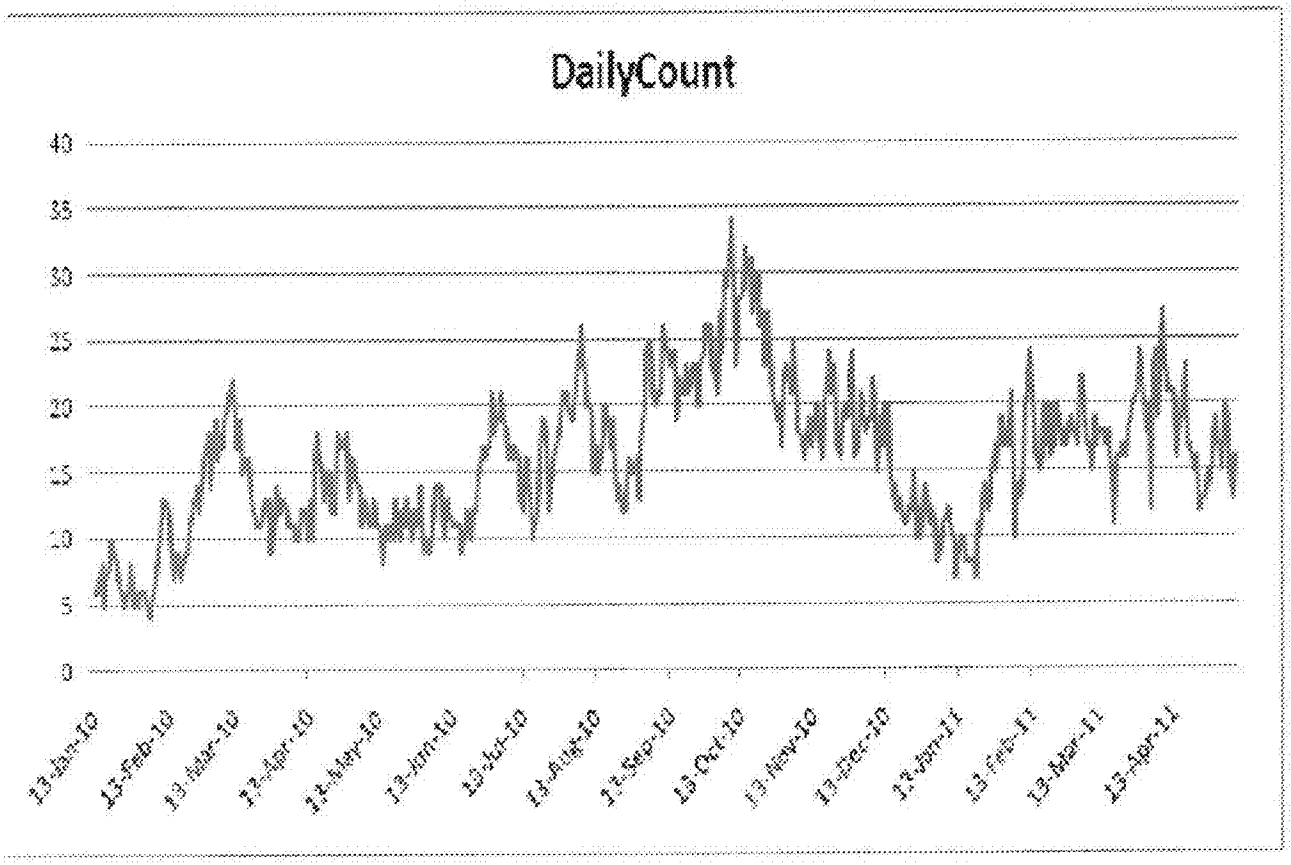
FIG. 14 shows a plot history of the number of daily feature alerts for an oil field, according to an embodiment of the present invention.

FIG. 14 illustrates daily alarm rates for an entire oil field. The training set consists of the all the artificial lift systems in the oil field, so it is impractical to apply assisted labeling techniques. All of the artificial lift systems from the oil field were used so that the alarm frequency that the subject matter expert (SME) experiences in the field using the induced models can be estimated. From FIG. 14, the average daily number of alarms is 4.1%. This daily alarm number is fairly low such that it is not excessively burdensome for the SMEs to review. Moreover, even though the highest number of daily alarms is 34, work load of SMEs is still reduced by over 90%.

Overfilling can occur when the model specializes on noise in the dataset instead of on the underlying concept. To assess the possibility of overfilling, a standard 10-fold cross validation on a training set is applied. In the model selection process, the parameter configurations with the highest accuracy were selected. The 10-fold cross validation accuracies are shown in the table below using different classification algorithms:

| Accuracy | Decision Tree | SVM | Bayesian Network |
|---|---|---|---|
| Failure | 0.916 | 0.943 | 0.939 |
| Normal | 0.990 | 1.000 | 0.973 |
| Overall | 0.970 | 0.985 | 0.964 |

The cross-validation is done at the sample level, not on artificial lift well level. The results demonstrate that support vector machines (SVMs) are the best option for providing the highest cross-validation accuracy for both failure and normal examples. Accordingly, SVMs are used herein as a final classifier, particularly SVMs with radial basis kernel. Other kernels could also be used such as linear kernels or polynomial kernels.

The cross validation error rates tend to be much lower than the testing set error rates. The difference between the error rates is most likely due to two causes. The first possible cause is that the labeling was completely automatically generated. As such, data noise and label problems can exist. The second possible cause of the error rate difference is that the training examples are not independent. In particular, the sliding window technique generates multiple examples for each artificial lift system. The 10-fold cross validation technique randomly assigns examples from each artificial lift system to one of the 10 folds. So, during the validation phase the learning algorithm most likely would have already seen examples from the artificial lift systems used for validation.

To understand whether the difference in error rates was caused by automatic labeling or by dependent samples, a modified cross validation methodology is employed. In particular, the modified cross validation methodology is based on a "leave one artificial lift well out" technique. In this approach, all the examples from the same artificial lift systems are kept for validation. Examples from the same artificial lift systems are not placed in both the training set and the testing set. A comparison between artificial lift well-level and sample-level cross validation accuracy using SVM is shown in the table below:

| Accuracy | Artificial Lift Well Level | Sample Level |
|---|---|---|
| Failure | 0.299 | 0.943 |
| Normal | 0.784 | 1.000 |
| Overall | 0.661 | 0.985 |

The cross-validation by the modified cross validation method results in much lower accuracy than the sample level method that leaves 10% of samples out during validation. The table also indicates that the artificial lift systems used in training are exclusive—representing different failure patterns.

Another dataset collected from an actual oil field was obtained to further, validate the failure prediction framework disclosed herein. The dataset includes a year and a half record (September/2009-February/2011) for 391 rod pump wells. Over that time, there were a total of 65 rod pump failures that occurred in 62 rod pump wells. Twelve attributes are considered that are relevant of failure signatures based on extracted features from dynamometer cards.

Before extracting the features, preprocessing work was performed to ensure the data quality. In particular, preprocessing was applied to clean up duplicated records, missing dates, noise, and coarse and sparse labels. The duplicated records were initially removed, and then the missing dates were padded by setting them to not-a-number (NaN) values, which represent undefined or unrepresentable values in computing that have no meaningful numeric result. Through this process, it was confirmed that the dates were in consecutive sequence for each artificial lift well. Since some of the events were recorded after the artificial lift system was down, in order to better evaluate the prediction algorithm, these events were shifted to the most recent working date—the exact day the artificial lift system failed.

After the preprocessing, sliding window feature extraction was performed. In particular, the sliding window feature extraction method shown in FIG. 6 was used. For training, eight artificial lift failure wells were selected that had consistent data (clear trends of failures). In the initial training stage the system was conditioned to true negative and true positive events, as described by the methods shown in FIG. 8. If systems still make false predictions (false negative event or false positive events) when deployed, then the false results can be corrected and added into the next training stage. As such, some normal artificial lift wells that have no previous known failures can be selected for failure precision correction purposes.

Once the model is fixed, all the 391 artificial lift wells were tested for all time periods. The below confusion matrix is obtained for prediction results, which correspond to the results obtained using the evaluation scheme illustrated in FIG. 11.

| | Actual Failure | Actual Normal |
|---|---|---|
| Predict Failure | 52 (TP) | 72 (FP) |
| Predict Normal | 13 (FN) | 254 (TN) |

In the confusion matrix, the recall for failure is 80.0% while the precision for failure is 41.9%. This means that even though 80% of the actual failures were captured, there are still over 50% that are likely falsely predicted. Furthermore, 72 false positives might contain some issues that showed failure patterns, which were not discovered by the SMEs. Lastly, a 95.1% confidence is obtained for artificial lift wells that are functioning normal if the algorithm predicts that the artificial lift system is normal.

Many modifications and variations of this invention can be made without departing from its spirit and scope, as will be apparent to those skilled in the art. For example, various other methods of training selection could be utilized to further increase the precision in predicting failures. Additionally, while support vector machines (SVMs) provided the highest cross-validation accuracy for both failure and normal predictions in the foregoing example results, other classification algorithms such as Bayesian Networks or Decision Trees can be utilized. The specific examples described herein are offered by way of example only, and the invention is to be limited only by the terms of the appended claims, along with the full scope of equivalents to which such claims are entitled.

As used in this specification and the following claims, the terms "comprise" (as well as forms, derivatives, or variations thereof, such as "comprising" and "comprises") and "include" (as well as forms, derivatives, or variations thereof, such as "including" and "includes") are inclusive (i.e., open-ended) and do not exclude additional elements or steps. Accordingly, these terms are intended to not only cover the recited element(s) or step(s), but may also include other elements or steps not expressly recited. Furthermore, as used herein, the use of the terms "a" or "an" when used in conjunction with an element may mean "one," but it is also consistent with the meaning of "one or more," "at least one," and "one or more than one." Therefore, an element preceded by "a" or "an" does not, without more constraints, preclude the existence of additional identical elements.

What is claimed is:

1. A method for failure prediction for artificial lift well systems, the method comprising:
- providing a production well associated with an artificial lift system and data indicative of an operational status of the artificial lift system;
- extracting one or more features from the data;
- applying data mining to the one or more features to determine whether the artificial lift system is predicted to fail within a given time period, wherein applying data mining to the one or more features comprises:
  - constructing a training set comprising true positive events;
  - iteratively adding false negative events into the training set until a converged failure recall rate is obtained; and
  - adding false positives into the training set to increase failure precision while maintaining the failure recall rate; and
- outputting an alert indicative of impending artificial lift system failures.

2. The method of claim 1, further comprising applying data preparation techniques to the data prior to extracting the one or more features from the data.

3. The method of claim 1, wherein extracting the one or more features from the data comprises applying a sliding window approach to extract multiple multivariate subsequences.

4. The method of claim 1, wherein extracting the one or more features from the data comprises:
- generating a multivariate time series;
- segmenting the multivariate time series into segments based on failure events; and
- applying a sliding window approach to extract multiple multivariate subsequences for each attribute within each of the segments.

5. The method of claim 1, wherein extracting the one or more features from the data comprises extracting multiple multivariate subsequences based on medians of attributes.

6. The method of claim 1, wherein applying data mining to the one or more features comprises:
- clustering artificial lift systems to be tested into a first cluster and a second cluster based on a class value, the first cluster being larger than the second cluster;
- labeling a centroid of the first cluster as a normal subsequences cluster;
- adding the centroid of the first cluster to a training set; and
- utilizing the training set to obtain an operational prediction for each artificial lift system.

7. The method of claim 1, wherein applying data mining to the one or more features comprises applying a support vector machine classifier.

8. The method of claim 1, wherein applying data mining to the one or more features comprises applying a random peek semi-supervised learning technique.

9. The method of claim 1, further comprising reducing noise in the data indicative of the operational status of the artificial lift system prior to extracting the one or more features.

10. A system for failure prediction for artificial lift well systems, the system comprising:
- a database configured to store data from an artificial lift system associated with a production well;
- a computer processor; and
- a computer program executable on the computer processor to implement a method, the method comprising:
- extracting data indicative of an operational status of the artificial lift system from the database;
- extracting one or more features from the data indicative of the operational status of the artificial lift system;
- applying data mining to the one or more features, wherein applying data mining to the one or more features comprises:
  - constructing a training set comprising true positive events;
  - iteratively adding false negative events into the training set until a converged failure recall rate is obtained; and
  - adding false positives into the training set to increase failure precision while maintaining the failure recall rate; and
- determining whether the artificial lift system is predicted to fail within a given time period.

11. The system of claim 10, wherein the computer program is further executable on the computer processor to reduce noise in the data indicative of the operational status of the artificial lift system prior to extracting the one or more features.

12. The system of claim 10, wherein the system further comprises a display configured to communicate with the computer processor executing the computer program such that an alert indicative of an impending artificial lift system failure is produced on the display.

13. The system of claim 10, wherein the computer program is further executable on the computer processor to extract multiple multivariate subsequences based on medians of attributes.

14. The system of claim 10, wherein the computer program is further executable on the computer processor to:

generate a multivariate time series;

segment the multivariate time series into segments based on failure events; and apply a sliding window approach to extract multiple multivariate subsequences for each attribute within each of the segments.

15. The system of claim 10, wherein the computer program is further executable on the computer processor to apply a random peek semi-supervised learning technique comprising:

clustering artificial lift systems to be tested into a first cluster and a second cluster based on a class value, the first cluster being larger than the second cluster;

labeling a centroid of the first cluster as a normal subsequences cluster;

adding the centroid of the first cluster to a training set; and utilizing the training set to obtain an operational prediction for each artificial lift system.

16. The system of claim 10, wherein the computer program is further executable on the computer processor to apply data preparation techniques to the data prior to extracting the one or more features from the data.

17. A non-transitory processor readable medium containing computer readable instructions for failure prediction for artificial lift well systems, the computer readable instructions executable on a computer processor to implement a method, the method comprising:

extracting data indicative of an operational status of an artificial lift system from a database;

extracting one or more features from the data indicative of the operational status of the artificial lift system;

applying data mining to the one or more features, wherein applying data mining to the one or more features comprises:

constructing a training set comprising true positive events;

iteratively adding false negative events into the training set until a converged failure recall rate is obtained; and adding false positives into the training set to increase failure precision while maintaining the failure recall rate; and determining whether the artificial lift system is predicted to fail within a given time period.

18. The non-transitory processor readable medium of claim 17, wherein the computer readable instructions are further executable on the computer processor to:

generate a multivariate time series;

segment the multivariate time series into segments based on failure events; and apply a sliding window approach to extract multiple multivariate subsequences for each attribute within each of the segments.

19. The non-transitory processor readable medium of claim 18, wherein the computer readable instructions are further executable on the computer processor to apply a random peek semi-supervised learning technique comprising:

clustering artificial lift systems to be tested into a first cluster and a second cluster based on a class value, the first cluster being larger than the second cluster;

labeling a centroid of the first cluster as a normal subsequences cluster;

adding the centroid of the first cluster to a training set; and utilizing the training set to obtain an operational prediction for each artificial lift system.

20. The non-transitory processor readable medium of claim 17, wherein the computer readable instructions are further executable on the computer processor to extract multiple multivariate subsequences based on medians of attributes.

* * * * *